US011828459B2

(12) United States Patent
Karjunen

(10) Patent No.: US 11,828,459 B2
(45) Date of Patent: Nov. 28, 2023

(54) CLEANING OF A RECOVERY BOILER

(71) Applicant: Varo Teollisuuspalvelut Oy, Helsinki (FI)

(72) Inventor: Timo Karjunen, Helsinki (FI)

(73) Assignee: Varo Teollisuuspalvelut Oy, Helsinki (FI)

( * ) Notice: Subject to any disclaimer, the term of this patent is extended or adjusted under 35 U.S.C. 154(b) by 0 days.

(21) Appl. No.: 17/275,554

(22) PCT Filed: Sep. 12, 2018

(86) PCT No.: PCT/FI2018/050653
§ 371 (c)(1),
(2) Date: Mar. 11, 2021

(87) PCT Pub. No.: WO2020/053470
PCT Pub. Date: Mar. 19, 2020

(65) Prior Publication Data

US 2022/0107085 A1 Apr. 7, 2022

(51) Int. Cl.

| | |
|---|---|
| ***F22B 37/48*** | (2006.01) |
| ***F23J 1/08*** | (2006.01) |
| ***F23J 3/02*** | (2006.01) |

(52) U.S. Cl.
CPC ..... *F22B 37/48* (2013.01); *F23J 1/08* (2013.01); *F23J 3/02* (2013.01); *F23J 2700/003* (2013.01)

(58) Field of Classification Search
None
See application file for complete search history.

(56) References Cited

U.S. PATENT DOCUMENTS

| | | | |
|---|---|---|---|
| 1,255,944 | A | 2/1918 | Stevens |
| 4,014,526 | A | 3/1977 | Cramer, Jr. |
| 4,437,765 | A | 3/1984 | Seeger |
| 4,488,516 | A | 12/1984 | Bueters et al. |
| 4,808,264 | A | 2/1989 | Kignell |
| 6,287,415 | B1 | 9/2001 | Salmi et al. |
| 6,311,630 | B1 | 11/2001 | Vanhatalo |
| 6,323,442 | B1 | 11/2001 | Jones |
| 2004/0226587 | A1 | 11/2004 | Lemire et al. |
| 2007/0137680 | A1 | 6/2007 | Fisher et al. |

(Continued)

FOREIGN PATENT DOCUMENTS

| | | | |
|---|---|---|---|
| GB | 2271440 | A | 4/1994 |
| JP | S5947493 | A | 3/1984 |

(Continued)

OTHER PUBLICATIONS

BLRBAC (Year: 2018).*

(Continued)

*Primary Examiner* — Steven S Anderson, II
*Assistant Examiner* — Kurt J Wolford
(74) *Attorney, Agent, or Firm* — ZIEGLER IP LAW GROUP LLC

(57) ABSTRACT

A method and apparatus for cleaning a black liquor recovery boiler, where a furnace floor of the boiler is washed by mixing wash water in a wash water pool formed on the floor by at least one mixing device in the wash water pool, and by jetting wash water towards the floor by at least one pressure washer installed into the furnace through an opening in the furnace wall.

17 Claims, 11 Drawing Sheets

(56) References Cited

U.S. PATENT DOCUMENTS

| | | | |
|---|---|---|---|
| 2008/0047587 | A1 | 2/2008 | Ball |
| 2008/0079203 | A1 | 4/2008 | Gibowski |
| 2009/0266277 | A1 | 10/2009 | Karjunen |
| 2010/0199930 | A1 | 8/2010 | Tandra |
| 2011/0232688 | A1 | 9/2011 | Karjunen |

FOREIGN PATENT DOCUMENTS

| | | | | | |
|---|---|---|---|---|---|
| JP | H0226909 | A | | 1/1990 | |
| JP | H02269009 | A | | 11/1990 | |
| JP | 2000039133 | A | | 2/2000 | |
| KR | 1020120115703 | A | | 10/2012 | |
| KR | 20130139097 | A | * | 12/2013 | ..... F22B 37/54 |
| KR | 101849476 | B1 | * | 4/2018 | ..... B08B 9/0839 |
| WO | 9927180 | A1 | | 6/1999 | |
| WO | 2008046959 | A1 | | 4/2008 | |
| WO | 2010063875 | A | | 6/2010 | |
| WO | 2017009519 | A1 | | 1/2017 | |
| WO | WO-2018026780 | A1 | * | 2/2018 | ..... F23G 7/04 |

OTHER PUBLICATIONS

Valmet (Year: 2017).*
Stone Age, BFW-100 (Year: 2017).*
BFW-100 User Manual (Year: 2017).*
Stone Age BFW-100, with Wayback Machine date verification (Year: 2017).*
"Improved recovery boiler cooling and washing practices", In: Valmet Technical Paper Series, pp. 1, 3, 7-10, Published Nov. 6, 2017, 10 pages.
European Patent Office, Communication pursuant to Article 94(3) EPC, Application No. 158981878, dated Jul. 31, 2019, 4 pages.
European Patent Office, Extended European Search Report, Application No. 158981878, dated Feb. 20, 2019, 6 pages.
Finnish Patent Office, Search Report, Application No. 20155558, dated Nov. 9, 2015, 2 pages.
International Search Report, Application No. PCT/FI2018/050653, dated Apr. 29, 2019, 4 pages.
Ministry of Economics, Forment and Tourism, Expert Report on Request for Invention Patent, Application No. 201800091, Dated Oct. 19, 2018, 8 pages.
Takahashi et al, "Annual Shutdown Cleanliness of the Recovery Boiler Furnace Floor", pp. 529-532, 2007 International Chemical Recovery Conference, 4 pages.
United States Patent and Trademark Office, Office Action, U.S. Appl. No. 15/742,064, dated Jan. 14, 2019, 24 pages.
Valmet Smelt-X esit, "Shorten your shutdowns & cut cost, Smelt-X, Smelt extraction" Nov. 6, 2015, http://www/valmet.com/Valmet/products/Vault2MP.nsf/BYWID/WID-140516-2256E-40DOB/$File/HPGB_H_2300_057-02_SmeltX_presentation.pdf?OpenElement, 28 pages.
PCT, Written Opinion of the International Searching Authority, Application No. PCT/FI2018/050653, dated Apr. 29, 2019, 8 pages.
PCT, Notification Relating to Declaration Made Under PCT Rule 4.17, Application No. PCT/FI2018/050653, dated Nov. 15, 2018, 1 page.
International Search Report, Application No. PCT/FI2015/050762, dated Jul. 1, 2016, 4 pages.

* cited by examiner

CLEANING OF A RECOVERY BOILER

TECHNICAL FIELD

The aspects of the disclosed embodiments generally relate to cleaning a recovery boiler. The aspects of the disclosed embodiments relate particularly, though not exclusively, to cleaning a black liquor recovery boiler when the boiler is being shut down.

BACKGROUND ART

This section illustrates useful background information without admission of any technique described herein representative of the state of the art.

Recovery boilers are fueled with waste liquor (black liquor) generated in connection with pulp manufacturing, the waste liquor containing various sodium salts, mainly sodium carbonate and sodium sulfate, in addition to organic compounds and water. These salts form a smelt bed on a furnace floor during boiler operation. During boiler operation, the bed is at least partly molten so that molten smelt flows continuously from the bed to smelt spouts through smelt spout openings typically located above the furnace floor, and further to a dissolving tank. Combustion of black liquor during boiler operation fouls upper portions of the boiler, such as the superheaters, the boiler bank and the economizers. Cleaning of the recovery boiler is needed in order to inspect, and when necessary service, the recovery boiler during boiler outage. Particularly, the furnace floor needs to be made free from smelt and other material remaining on the furnace floor.

Boiler outages may cost millions of euros mainly due to loss of production. Typically, the shut down and cleaning of the recovery boiler last several days. Introducing more efficient methods for cleaning recovery boilers could result in significant savings in resources, such as workforce, time and money.

SUMMARY

According to a first aspect of the disclosed embodiments, there is provided a method for cleaning a black liquor recovery boiler comprising washing a furnace floor of the boiler, said washing comprising:

- mixing wash water in a wash water pool formed on the floor by at least one mixing device in the wash water pool; and
- jetting wash water towards the floor by at least one pressure washer installed into the furnace through an opening in the furnace wall.

In certain embodiments, the method comprises: mixing the wash water in the wash water pool, prior to said washing by the at least one pressure washer, by the at least one mixing device in the wash water pool. In certain embodiments, the mixing is performed by sucking wash water in the wash water pool into suction opening(s) of the mixing device(s) and discharging the sucked wash water back through discharge opening(s) of the mixing device(s).

In certain embodiments, the method comprises installing said mixing devices on the furnace floor before said mixing. In certain embodiments, the method comprises installing said mixing devices into the wash water pool before said mixing. In certain embodiments, the method comprises removing the mixing devices from the furnace after completing said mixing.

In certain embodiments, installing at least one pressure washer into the furnace comprises pushing the at least one pressure washer from outside the furnace into the furnace through an opening in the furnace wall. In certain embodiments, where more than one pressure washer is installed, each pressure washer is installed through a respective opening in the furnace wall. In certain other embodiments, where more than one pressure washer is installed, two or more pressure washers are installed through a same opening in the furnace wall. In certain embodiments, the opening for said at least one pressure washer to be installed through is an opening other than a smelt spout opening. In certain embodiments, the at least one pressure washer is installed through a burner opening, a secondary air port (secondary air inlet or secondary air opening), or a liquor gun port (liquor gun opening).

In certain embodiments, the method comprises removing the at least one pressure washer from the furnace after completing said washing by the at least one pressure washer. In certain embodiments, said removing the at least one pressure washer from the furnace comprises withdrawing or pulling the at least one pressure washer from the furnace through said opening through which the at least one pressure washer was installed.

In certain embodiments, the water pressure used in the at least one pressure washer is 400 bars or greater. In certain embodiments, the water pressure for the at least one pressure washer is raised by a pressure-boosting pump.

In certain embodiments, wash water is jetted towards the furnace floor by two pressure washers. In certain embodiments, the jetting is performed by said two pressure washers concurrently. In certain embodiments, the at least one pressure washer comprises at least one washing nozzle configured to jet a stream of water. In certain embodiments, the at least one pressure washer comprises two washing nozzles each jetting a stream of water, said streams being directed in opposite directions.

In certain embodiments, the method comprises: removing wash water from the wash water pool with at least one first suction device during said jetting of wash water by at least one pressure washer.

In certain embodiments, the method comprises: keeping, during said jetting of wash water by at least one pressure washer, the surface of the wash water pool formed on the floor below the level of a lower edge of smelt spout openings in the furnace wall by removing wash water from the wash water pool with at least one first suction device.

In certain embodiments, in which smelt spout openings are arranged at different heights in the furnace wall, the method comprises keeping, during said washing, the surface of the wash water pool below the level of a lower edge of the lowest smelt spout opening in the furnace wall by removing wash water from the wash water pool with at least one first suction device. In certain embodiments, removing wash water from the wash water pool comprises decreasing the size of the wash water pool while performing said washing by at least one pressure washer. In certain embodiments, the method comprises: removing the wash water by an ejector or an eductor or a siphon device during the washing of the furnace floor. In certain embodiments, said ejector or eductor or siphon device is operated by a pressure medium, preferably pressurized air, in certain other embodiments by pressurized water. In certain embodiments, the first suction device is installed so that a suction pipe of the first suction device extends into the wash water pool. In certain embodiments, the method comprises: removing wash water from the wash water pool, directly or through a spout, into a dissolving tank, or another collection system.

In certain embodiments, the method comprises: removing smelt in a molten state from the furnace floor by at least one second suction device prior to said washing. In certain embodiments, the method comprises removing smelt in a molten state by an ejector or an eductor or spiral pump or a siphon device. In certain embodiments, the method comprises removing smelt in a molten state by an ejector or eductor or a siphon device operated by a pressure medium, preferably pressurized air. In certain embodiments, the pressurized air is conducted into the ejector or eductor or siphon device by a pressurized gas line in fluid connection with a pressurized air source to create a suction (or a start suction in the case of the siphon device) from the furnace of the recovery boiler. In certain embodiments, the first suction device and the second suction device are the same device. In certain embodiments, said removing smelt in a molten state is performed before washing of boiler's upper portion. In certain embodiments, the boiler's upper portion comprises superheaters, economizers and a boiler bank.

In certain embodiments, fresh wash water is pumped to the furnace floor prior to said mixing, or during said mixing, or both. In certain embodiments, the method comprises guiding fresh wash water towards the furnace floor, for example by spraying, through a liquor port, a primary air port, or a man door prior to said mixing, or during said mixing, or both.

In certain embodiments, the method comprises: washing an underside of a nose protruding from a furnace wall by directing fresh wash water to said underside during the mixing of wash water in the wash water pool. In certain embodiments, said wash water directed to said underside is fed through an opening in the furnace wall, such as a man door or inspection hatch. In certain embodiments, washing the underside of said nose is performed before performing the washing by at least one pressure washer.

In certain embodiments, the method, comprises: starting the washing of boiler's upper portion from superheaters. In certain embodiments, the method comprises: performing said mixing during a washing phase in which superheaters of the boiler are being washed. In certain embodiments, the method comprises: washing an underside of a nose protruding from a furnace wall by directing fresh wash water to said underside during a washing phase in which superheaters of the boiler are being washed. In certain embodiments, the method comprises: performing said mixing and said washing of the underside of the nose during a washing phase in which superheaters of the boiler are being washed.

In certain embodiments, the method comprises: performing at least part of said washing by at least one pressure washer during a washing phase in which superheaters of the boiler are being washed. In certain embodiments, the method comprises: performing said washing by at least one pressure washer during washing the remaining parts of the boiler's upper portion after superheaters of the boiler have been washed.

In certain embodiments, the method comprises: performing said washing a furnace floor of the boiler during washing phases in which the superheaters, the economizers, and the boiler bank of the boiler are being washed.

In certain embodiments, the method comprises: performing washing by at least one pressure washer at the rear wall side of the furnace during a washing phase in which superheaters of the boiler are being washed. In certain embodiments, the rear wall of the furnace is the wall from which the nose is protruding. In certain embodiments, the method comprises: performing washing by at least one pressure washer at the front wall side of the furnace during washing the remaining parts of the boiler's upper portion after superheaters of the boiler have been washed. In certain embodiments, the front wall of the furnace is the wall opposite to the rear wall.

In certain embodiments, performing washing by at least one pressure washer in the rear wall side of the furnace comprises providing at least one pressure washer in the rear wall (back wall) side of the furnace. In certain embodiments, performing washing by at least one pressure washer at the front wall side of the furnace comprises providing at least one pressure washer in the front wall side of the furnace.

According to a second aspect of the disclosed embodiments, there is provided an apparatus for cleaning a black liquor recovery boiler, comprising means for performing the method of the first aspect or any of its embodiments.

The apparatus comprises at least one mixing device in addition to at least one pressure washer.

Accordingly, in certain embodiments, the apparatus comprises:

- at least one mixing device for washing a furnace floor of the boiler by mixing wash water in a wash water pool formed on the floor by the at least one mixing device positioned (or installed) in the wash water pool; and
- at least one pressure washer for jetting wash water towards the floor by the at least one pressure washer installed into the furnace through an opening in the furnace wall.

In certain embodiments, the at least one mixing device and the at least one pressure washer are devices that operate without human presence within the furnace. Accordingly, the devices are non-hand-held devices in this sense.

In certain embodiments, the apparatus comprises at least one suction device for removing wash water from the wash water pool.

In certain embodiments, the apparatus comprises means for keeping, during said washing, the surface of a wash water pool formed on the floor below the level of a lower edge of smelt spout openings in the furnace wall. In certain embodiments, the means for keeping comprise at least one first suction device for removing wash water from the wash water pool.

According to a third aspect of the disclosed embodiments, there is provided a method for cleaning a black liquor recovery boiler, comprising:

- washing a furnace floor of the boiler by jetting wash water towards the floor by at least one pressure washer installed into the furnace through an opening in the furnace wall.

In certain embodiments, the method of the third aspect comprises: removing wash water from the wash water pool with at least one first suction device. In certain embodiments, the method of the third aspect comprises keeping, during said washing, the surface of a wash water pool formed on the floor below the level of a lower edge of smelt spout openings in the furnace wall by removing wash water from the wash water pool with at least one first suction device.

In certain embodiments, the method of the third aspect comprises removing smelt in a molten state from the furnace floor by at least one second suction device prior to said washing.

According to a fourth aspect of the disclosed embodiments, there is provided an apparatus for cleaning a black liquor recovery boiler, comprising means for performing the method of the third aspect or any of its embodiments.

In certain embodiments, the apparatus of the fourth aspect comprises:

at least one pressure washer for washing a furnace floor of the boiler by jetting wash water towards the floor by the at least one pressure washer installed into the furnace through an opening in the furnace wall.

In certain embodiments, the apparatus of the fourth aspect comprises at least one suction device for removing wash water from the wash water pool.

In certain embodiments, the apparatus of the fourth aspect comprises means for keeping, during said washing, the surface of a wash water pool formed on the floor below the level of a lower edge of smelt spout openings in the furnace wall. In certain embodiments, the means for keeping comprise at least one first suction device for removing wash water from the wash water pool.

Without limiting the scope and interpretation of the patent claims, certain technical effects of one or more of the example embodiments of this disclosure are listed in the following. A technical effect is a faster, more efficient method for cleaning a recovery boiler. Cleaning of the recovery boiler may be carried out in a significantly reduced time (significantly faster). Since the time needed for the recovery boiler maintenance largely influences the total outage time of the mill, reducing the cleaning time of the recovery boiler reduces the total mill outage time. This results in a reduction in loss of production caused by the outage. A further technical effect is a more effective method for cleaning a recovery boiler resulting in improved cleaning results. Furthermore, keeping the surface of the wash water pool formed on the furnace floor below the level of the lower edge of smelt spout openings during the washing by at least one pressure washer renders said washing more effective. Further, keeping the surface of the wash water pool formed on the furnace floor below the level of the lower edge of smelt spout openings during the washing by at least one pressure washer allows carrying out said washing with fewer pressure washers, which saves resources. Yet further, the method may optionally be carried out without using a vacuum truck (suction truck).

Different non-binding example aspects and embodiments of the present disclosure have been illustrated in the foregoing. The embodiments in the foregoing are used merely to explain selected aspects or steps that may be utilized in implementations of the present disclosure. Some embodiments may be presented only with reference to certain aspects of the present disclosure. It should be appreciated that corresponding embodiments may apply to other aspects as well, and any appropriate combinations may be formed.

BRIEF DESCRIPTION OF THE DRAWINGS

Some example embodiments of the present disclosure will be described with reference to the accompanying drawings, in which.

DETAILED DESCRIPTION

In the following description, like reference signs denote like elements or steps.

In this disclosure the terms "fresh wash water" and "fresh water" refer to water that is provided for washing the boiler, and which water has not yet been used for washing the boiler (i.e., non-recirculated water).

Figure 1:
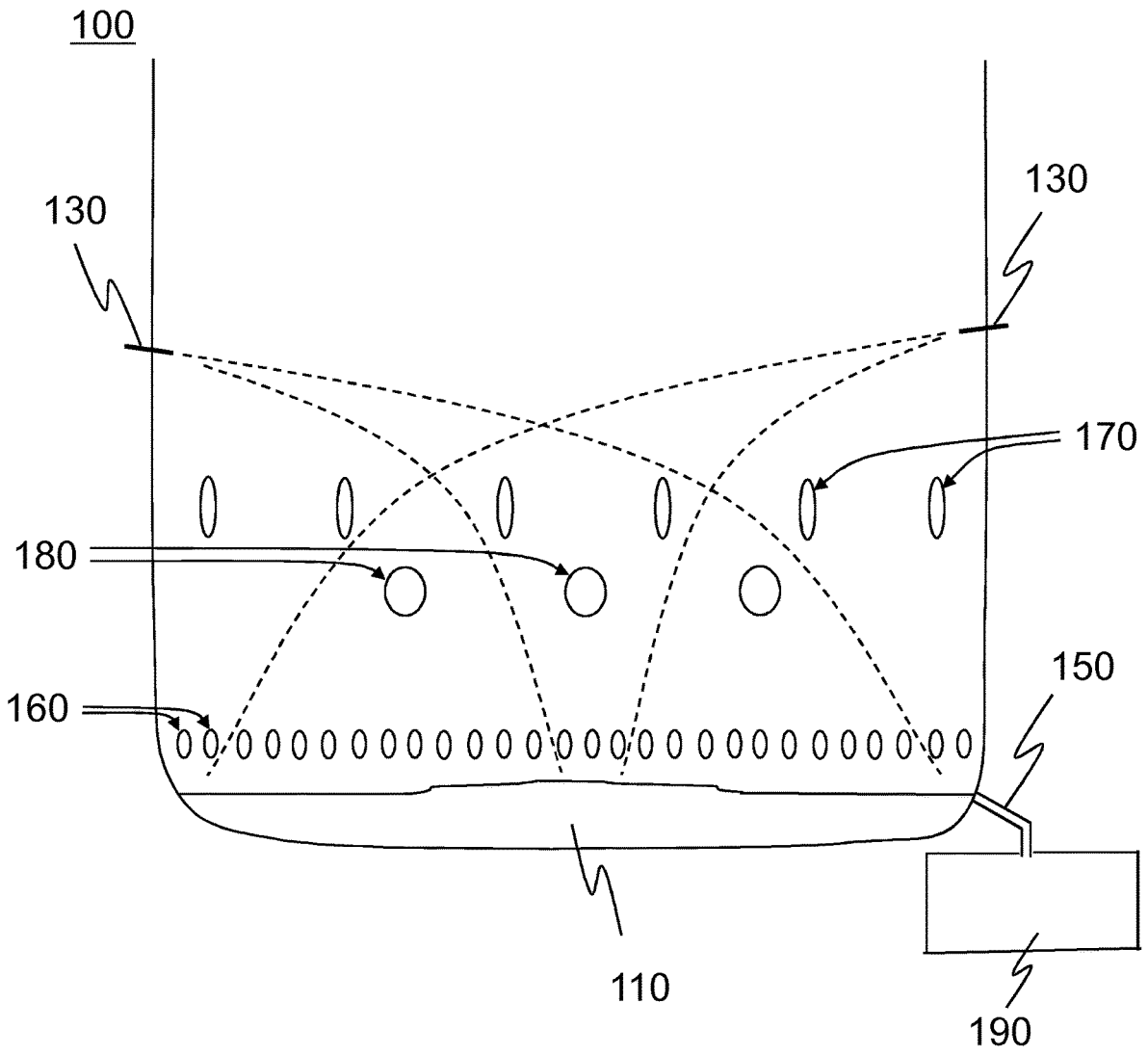
FIG. 1 shows a schematic drawing of a cross-section of an example of a recovery boiler in the area of a furnace of the recovery boiler during boiler operation.

FIG. 1 shows, according to an example, a schematic drawing of a cross-section of a black liquor recovery boiler 100 in the area of a furnace of the recovery boiler during boiler operation. In FIG. 1, there is a partly molten smelt pool 110 on a floor of the boiler 100. During the operation illustrated in FIG. 1, black liquor is conducted (sprayed) into the boiler with black liquor nozzles (liquor guns) 130, typically from black liquor spray openings in all four furnace walls of the boiler, so that, when the boiler 100 is fully loaded, there are typically 6 to 10 black liquor nozzles 130 in use. However, the amount of black liquor nozzles depends on the size of the boiler 100, and less or more nozzles may be in use. The black liquor spray openings are typically at a height of 6 to 7 meters from the floor, however, the positions of the openings depend on the boiler 100 size. During the operation illustrated in FIG. 1, the combustion of the black liquor in the furnace of the boiler 100 is controlled by conducting air into the boiler from primary air openings (primary air ports) 160, secondary air openings (secondary air ports) 170 and tertiary air openings (tertiary air ports, not shown). During the operation illustrated in FIG. 1, the smelt forming on the floor flows from the smelt pool 110 through smelt spouts 150 to a dissolving tank 190 by gravity. Typically, the boiler comprises 2 to 12 smelt spout openings, however, the number of smelt spouts and smelt spouts openings depends on the boiler size.

When a recovery boiler 100 is shut down, any char bed remaining on the floor of the boiler may be burned away and the smelt bed remaining on the floor may be melted so that excess smelt can flow out from the furnace by gravity through smelt spouts 150. The floor formed of floor tubes is then covered with a remaining smelt bed (or smelt pool) with a top surface level corresponding to the level of the smelt spout openings (i.e., level of a lower edge of the smelt spout openings). In some recovery boilers, the smelt spout openings are located 200-250 mm above the lower edge of the furnace wall. The smelt spouts are generally arranged in the rear wall of the furnace, i.e. in a wall of the furnace from which a nose of the boiler is protruding. However, in a few recovery boilers, smelt spouts may be arranged in a side wall or a front wall of the furnace. Modern recovery boilers may have a so called decanting floor, with floor tubes sloping downwards from the rear wall towards the centerline of the floor. Therefore, in these recovery boilers, the middle line of the floor is below the lower edge of the furnace rear wall. The middle line of the floor may in some recovery boilers be from 300 to 700 mm below the smelt spout opening level.

In boiler furnaces with a decanting floor, the remaining smelt bed may thus have a thickness of about 200-250 mm near the front and rear walls, while around the middle of the floor the bed is considerably thicker, about 300-700 mm, but the thickness of the smelt bed depends on the boiler size and floor tube slope. Recovery boilers have become gradually larger so that modern recovery boilers may have a floor area of about 150-300 $m^2$. Consequently, the smelt bed on the floor of a modern recovery boiler may after the removal of molten smelt through the smelt spouts by gravitation be large both in thickness and volume. In particularly large boilers the smelt bed thickness at the floor centerline may be about 0.5-0.7 m and the total volume of the bed may be over 100 $m^3$.

The smelt contains typically as main components sodium carbonate (65-75%) and sodium sulfide (19-25%). As direct contact of water with molten smelt can result in smelt-water explosion, water can be safely introduced into the furnace after the smelt pool has cooled down and solidified completely.

Next, a method for cleaning a black liquor recovery boiler is described.

In certain embodiments, the method comprises decreasing the size of the smelt bed (or smelt pool) before introducing wash water to the boiler furnace 200. The size of the smelt pool may be decreased by introducing a suction device, such as an ejector, an eductor, or a (spiral) pump, or a siphon device, through an opening arranged in the wall of the furnace 200 of the recovery boiler 100, such as a smelt spout opening, and suck molten smelt from below the level of the smelt spout openings. In certain embodiments, the suction device is a smelt eductor or smelt ejector based on negative pressure suction generated by a pressurized gas flow in the eductor or ejector. The suction device may be installed so that a suction pipe of the suction device extends below the level of the smelt spout openings into the molten smelt bed (smelt pool) on the floor of the furnace 200. More than one suction device, for example 2-10 suction devices, may be used to suck molten smelt from the furnace 200. The amount of suction devices used for smelt removal depends on the size of the boiler 100 and of the smelt pool. In certain embodiments, the at least one suction device is removed from said opening arranged in the furnace wall after having completed removing smelt in a molten state from the furnace floor.

Before introducing wash water into the furnace 200, the boiler 100 is depressurized and cooled down in certain embodiments. The depressurization may be performed while cooling the boiler materials and the smelt remaining on the furnace 200 floor. The boiler 100 may be depressurized by opening a start-up valve as needed. The duration of the depressurization of the boiler 100 is in certain embodiments about 4-6 hours. In certain embodiments, the material (smelt) remaining on the floor of the furnace 200 may be cooled for example by blowing air (without pre-heating), such as primary air, into the furnace. The time required for sufficient cooling depends heavily on the amount of smelt on the furnace 200 floor, which smelt should be solidified before performing water washing steps or introducing wash water into the furnace. The cooling and solidification of the remaining smelt is notably faster if a significant portion of the smelt bed has been removed with the at least one suction device as described above.

Water washing of the boiler 100 may begin as soon as the material temperatures are low enough. Some pulp mills apply guidelines determining the highest allowed temperature difference between material temperatures and wash water temperature. In certain embodiments, the difference between boiler material temperatures and wash water temperature is 50° C. or less when wash water is introduced into the boiler 100. In certain embodiments, in which hot feedwater or condensate is used for washing, the temperature difference between the hot feedwater or condensate and the material temperatures is about 50° C. or less. In certain embodiments, hot water has a temperature of up to 100° C. In certain embodiments, in which compound tubes are used, the material temperatures are below 150° C. when introducing wash water into the boiler 100 to minimize the risk of stress corrosion cracking.

In certain embodiments, water washing steps comprise washing the furnace floor, and washing the boiler's upper portion. In certain embodiments, washing the furnace floor of the boiler comprises a pressure washing step performed with pressure washers, and a mixing step in which water in a wash water pool on the furnace floor is mixed with at least one or a plurality of mixing devices. Said pressure washing step and said mixing step may be performed concurrently or one after the other, for example starting the mixing step before the pressure washing step or starting the pressure washing step before the mixing step. In certain embodiments, said mixing step and said pressure washing step are started at different times, but a portion of the mixing step and of the pressure washing step are performed simultaneously. In certain embodiments, washing the boiler's upper portion comprises washing economizers, a boiler bank, or superheaters of the boiler (or any combination thereof) with a soot blower or soot blowers.

In certain embodiments, the at least one suction device for removing smelt in a molten state from the smelt pool is removed from the opening arranged in the furnace wall through which it was introduced to the furnace before starting washing the furnace floor.

Figure 2:
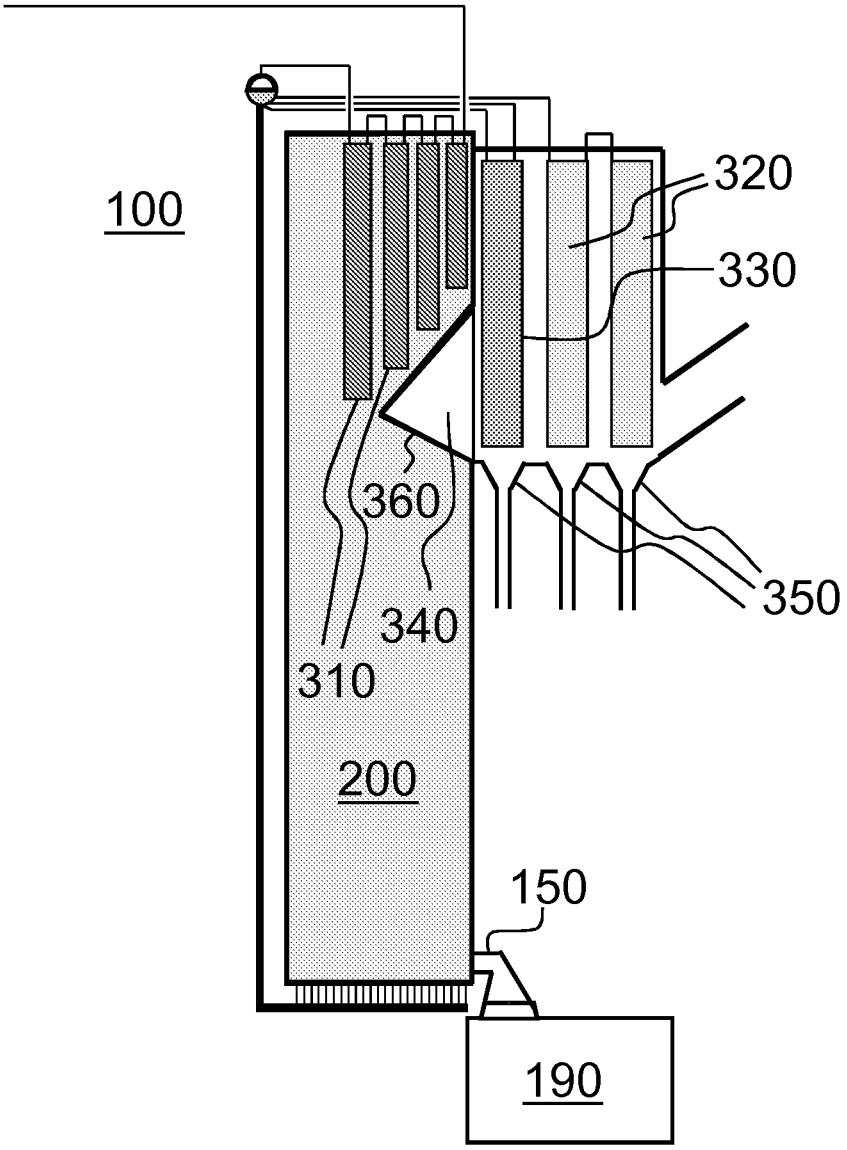
FIG. 2 shows a schematic cross-sectional drawing of parts of a recovery boiler according to an embodiment.

In certain embodiments, as mentioned in the preceding, water washing steps comprise washing the furnace floor and upper portion (i.e., the economizers, the boiler bank, and the superheaters) of the boiler. FIG. 2 shows a schematic cross-sectional drawing of parts of the boiler 100 according to an embodiment. The superheaters 310, boiler bank 330 and economizers 320 are arranged in the upper portion of the boiler 200. A nose 340 protrudes from a rear wall of the furnace 200. In the embodiment of FIG. 2, ash (and other solid deposits) removed from the boiler bank 330 and the economizers 320 is mainly collected by ash hoppers 350. In certain embodiments, wash water used in washing of the economizers and/or boiler bank drains into the ash hoppers 350. Removed ash may be recovered and recycled. In certain embodiments, washing of economizers 320, the boiler bank 330, and/or superheaters 310 starts before commencing pressure washing of the furnace 200 floor. In certain embodiments, washing the furnace floor starts before starting to wash economizers 320, boiler banks 340, and/or superheaters 310, depending on the embodiment. In certain other embodiments, the pressure wash step or the mixing step starts before starting to wash economizers 320, boiler banks 340, and/or superheaters 310, depending on the embodiment.

Washing of superheaters 310 with a soot blower or soot blowers releases solid deposits (comprising as a main component sodium sulphate) from the superheaters 310. The material removed or released from the superheaters 310 falls mainly to the front wall side of the furnace floor. In the embodiment of FIG. 2, a nose 340 protruding from the rear wall prohibits the released solid deposits from falling from the superheaters 310 to the rear wall side of the furnace floor. The material falling from the superheaters 310 when the superheaters 310 are washed with the soot blower(s) may damage washing equipment, such as pressure washers, pressure washer installation rods or wires, installed in the front wall side of the furnace 200. The amount of material (solid deposit) falling down from the superheaters 310 varies. In certain embodiments, the amount of material falling down from the superheaters 310 is large, several tens of $m^3$. If a pressure washer is hit by a large deposit block, the installation supports may be bended so that a washing nozzle reaches the floor tubes. If this happens, the washing nozzle may hit the boiler 100 tubes hard causing mechanical damages to the tubes. Likewise, if a washing nozzle configured to jet water in two opposite directions is damaged so that it is no longer balanced by two water jets directed in opposite directions, the washing nozzle may start swinging and may, if installed close to the wall, hit wall tubes causing mechanical damages. In certain embodiments, pressure washer(s) are installed to the front wall side of the furnace after inspecting that no large deposit remains in the superheaters. In certain embodiments, washing the superheaters 310 by one or more soot blowers comprises treating the superheaters 310 with the soot blower(s) a certain number of times, for example three times. In certain embodiments, the method comprises installing washing equipment (pressure washers) in the front wall side of the furnace 200 after having treated the superheaters 310 with the soot blower(s) a number of times, the number of times being less than said certain number of times, for example a first time.

In certain embodiments, the washing of the boiler's upper portion with a soot blower or soot blowers commences as soon as the pressure of the boiler has been lowered so that material temperatures and the temperature of the smelt remaining on the furnace floor are low enough to safely introduce wash water. In certain embodiments, the washing of the upper portion of the boiler 100 is started from the superheaters 310 when the temperature difference between boiler materials and wash water is 50° C. or less. Accordingly, a recovery boiler cleaning method comprises, in certain embodiments, starting the washing of superheaters 310 before (or at least not later than) starting the washing of the economizers 320. In certain embodiments, the method comprises starting the washing of superheaters 310 before (or at least not later than) starting the washing of the boiler bank 330. In certain embodiments, the washing of superheaters 310 is started simultaneously as the washing of the economizers 320 and/or the boiler bank 330. In certain embodiments, simultaneously means that the washing starts approximately at the same time and at least that the washing of superheaters 310 is not started considerably later than the washing of the economizers 320 and/or the boiler bank 330 although the washing would not start at an exactly same time instant. In yet further embodiments, washing the economizers 320 and boiler bank 330 starts after the washing of the superheaters 310 is terminated or finished. In certain embodiments, the method comprises starting the washing of the economizers 320 before starting the washing of the superheaters 310 (and/or the boiler bank 330). The cooling of the economizers of the boiler 100 may be expedited by pumping feedwater into economizer conduits (and by making room for feedwater by draining water from the conduits). In certain embodiments, washing of the economizers with one or more soot blowers starts during depressurization of the boiler. In certain embodiments, the washing of the economizers begins when the difference between temperatures of economizer materials and wash water temperature is 50° C. or less.

In certain embodiments, the washing of superheaters 310 is performed simultaneously as washing of the furnace floor. In certain embodiments, the washing of superheaters 310 is performed simultaneously as washing of the furnace floor with mixing devices and/or pressure washers. Starting the washing of superheaters 310 at an early stage of water washing provides more time for cleaning deposits that fall from the superheaters 310 to the furnace floor when washing the superheaters 310.

In some boilers solid deposits may accumulate on an underside 360 of the nose 340 protruding from the rear wall of the furnace 200. The amount of accumulated deposits may vary. Generally, the underside 360 of the nose 340 is not treated with soot blowers during the operation of the recovery boiler and consequently, there are generally no soot blowers in the area below the nose 340. In certain embodiments, the underside 360 of the nose 340 is, during the boiler shut down, washed by means other than soot blowers. In certain embodiments, the area below the nose 340 is washed by directing water (fresh wash water), for example by spraying or jetting, towards the underside 360 of the nose 340 to remove solid deposits. Said water may be guided into the furnace 200 through an opening in the furnace wall. The opening may be for example an opening on the same side of the furnace 200 as the nose 340 (rear side), or approximately below the nose 340. In certain embodiments, said opening is arranged in the wall on the opposite side of the furnace 200 than the nose 340 (i.e. an opening arranged in the front side wall). The water may be directed or conducted (or sprayed) with an apparatus providing enough pressure so that said water reaches the underside 360. In certain embodiments, water is directed towards the underside 360 of the nose 340 to remove solid deposits with an apparatus providing a pressure of 10-15 bars. In certain embodiments, the pressure provided by the apparatus for directing (conducting) water towards said underside 360 is higher than 15 bars. The water may be sprayed with a water gun or similar installed through a man door or inspection hatch in the vicinity of the area below the nose 340.

If large amounts of solid deposit falls to the furnace floor during washing the underside 360 of the nose 340, pressure washers installed under the nose may be damaged by falling deposit blocks. Similarly, pressure washer installation rods or wires (if any) below said nose 340 may be damaged by falling deposit blocks. Solid deposits from below the nose 340 falls mainly to the rear wall side of the furnace floor. In certain embodiments, performing washing by at least one pressure washer is performed after washing the underside 360 of the nose 340. In certain embodiments, the underside 360 of the nose 340 is washed during the washing of superheaters. In certain such an embodiment, also the washing of the upper portion of the boiler may be started from the superheaters. In certain embodiments, the underside 360 of the nose 340 is washed during the washing of economizers 320. In certain such an embodiment, also the washing of the upper portion of the boiler may be started from the economizers.

In certain embodiments, solid deposits fallen to the furnace floor when washing the superheaters 310, the underside 360 of the nose 340, or both, forms a pile or piles on the furnace floor. In certain embodiments, fallen deposits and smelt remaining on the furnace floor is at least partly dissolved or washed before performing washing by the at least one pressure washer. The smelt remaining on the furnace floor may originate from the smelt bed 110 optionally reduced in size, and the fallen deposits may originate from the superheaters 310, and/or the underside 360 of the nose 340. The removal of fallen deposits and smelt remaining in the furnace may be enhanced by directing (or spraying) water on the formed pile(s) using liquor or water guns or hoses installed through openings in the furnace wall. Warm or hot (up to 100° C.) fresh wash water to dissolve smelt and fallen deposit on the furnace floor may be guided into the furnace for example through a start-up burner opening or burner openings 180 (FIG. 1), or liquor port(s) 130, or a primary air port(s) 160. In certain embodiments, the directing of fresh wash water towards the furnace floor is performed during, or as a part of, washing the furnace floor with pressure washers. In certain embodiments, the directing of fresh wash water towards the furnace floor is performed during, or as a part of, the mixing step comprised in washing the furnace floor. In certain embodiments, the opening(s) in the furnace wall trough which fresh wash water is directed towards the furnace floor is changed or altered during the cleaning of the boiler. Changing the position of a water stream directed towards the furnace floor allows better focusing of said water stream or allows said water stream to cover a larger area.

Figure 3:
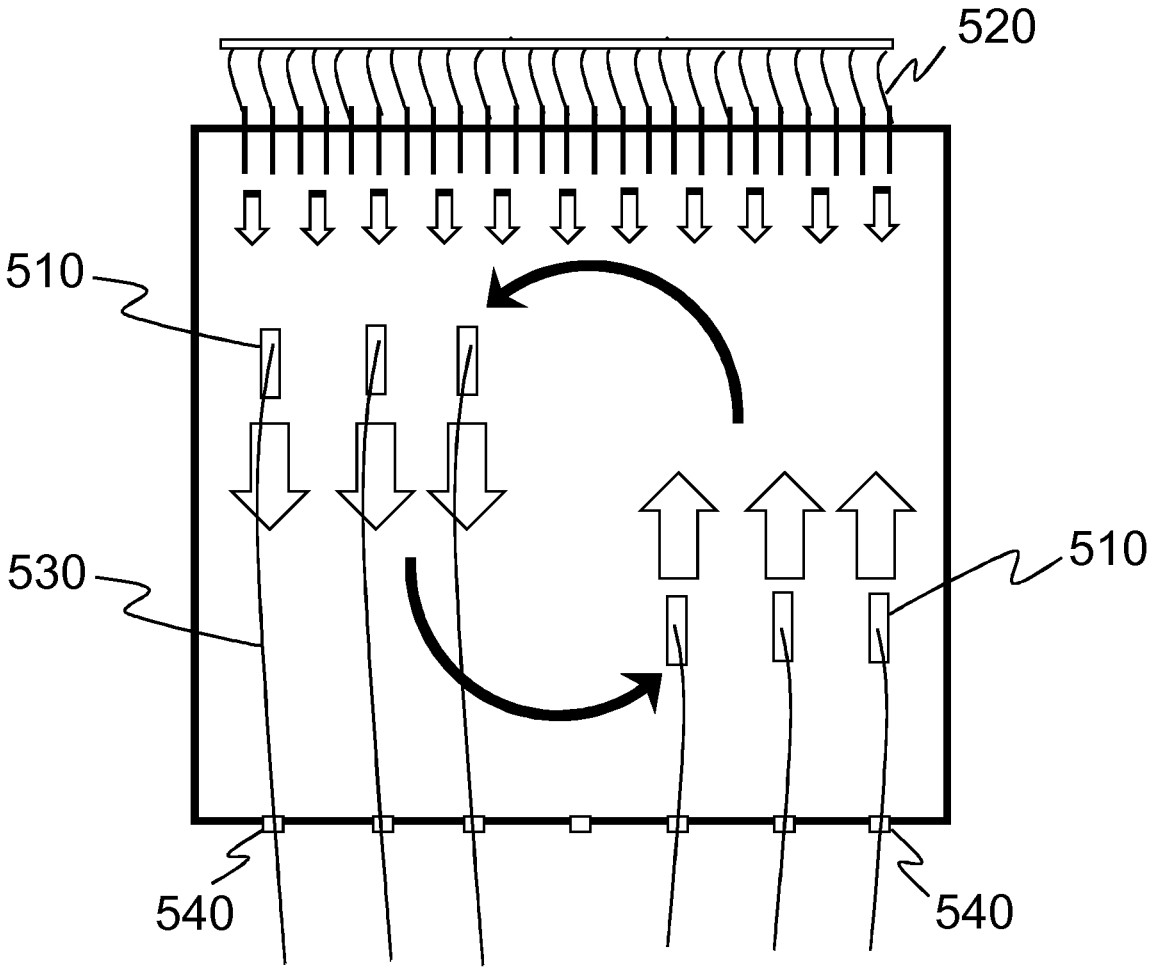
FIG. 3 shows a schematic drawing of an arrangement for mixing water in a wash water pool on a floor of a furnace according to an embodiment.

In certain embodiments as described in the preceding, fresh wash water is pumped onto the furnace floor. The wash water accumulating on the furnace floor forms a wash water pool. In certain embodiments, the wash water pool on the furnace floor is mixed by a mixing device or a plurality of mixing devices to dissolve salt remaining on the floor into the wash water. The mixing may be performed to prevent stratification of the water of the wash water pool on the furnace floor. FIG. 3 shows an arrangement in accordance with such an embodiment.

Warm or hot fresh wash water is pumped for example from a feedwater or condensate tank (not shown) to wash water providing means such as wash water nozzles 520 installed in one or more openings, for example primary air openings, in the furnace wall.

Mixing device(s) 510 installed to reach the wash water pool cause the water volume on the floor to move and to mix thus preventing vertical stratification of wash water which would disturb dissolution of salt into the wash water. The mixing devices may be installed to the furnace floor or into the wash water pool through one or more openings in the furnace wall, for example smelt spout openings. In certain embodiments, two mixing devices are installed through one opening. Installing two mixing devices through one opening in the furnace wall may be particularly beneficial when cleaning large boilers. The mixing device(s) are removed from the furnace after having completed the mixing step.

The mixing devices 510 can be placed into the furnace so that the mixing of wash water pool is as efficient as possible or, for example, so that mixing is most efficient in areas with the highest concentration of salt (smelt and fallen deposits). FIG. 3 shows with arrows the wash water flow direction during mixing. The number of mixing devices and their locations in the furnace 200 may be selected or determined so that sufficient mixing of the wash water pool is achieved. The selection or determination may be based for example on the size of the boiler 100 and the amount and type of the material (smelt and fallen deposit) to be (at least partially) dissolved.

The used mixing devices 510 depend on the embodiment. As an example, FIG. 3 shows mixing devices 510 operated by a pressure medium, such as pressurized air. A pressure medium tube 530 passes through a respective opening in the furnace wall, for example smelt spout opening 540, to each mixing device 510 set into the wash water pool. The pressure medium tube 530 discharges the pressure medium with a high velocity into inside of a suction pipe of the mixing device 510. The discharged pressure medium sucks wash water into a suction opening of the mixing device 510. The mixture of water and pressure medium exits at an opposite end of the suction pipe to implement said mixing. Other examples of mixing devices are other pumps or for example propellers etc. that may be set on the wash water pool.

The above described mixing step may be performed before or during the pressure wash step. In certain embodiments, said mixing step is performed after the pressure wash step. In certain embodiments, the above described mixing step is performed during washing of the boiler's upper portion, and/or during the pressure wash step.

Figure 4:
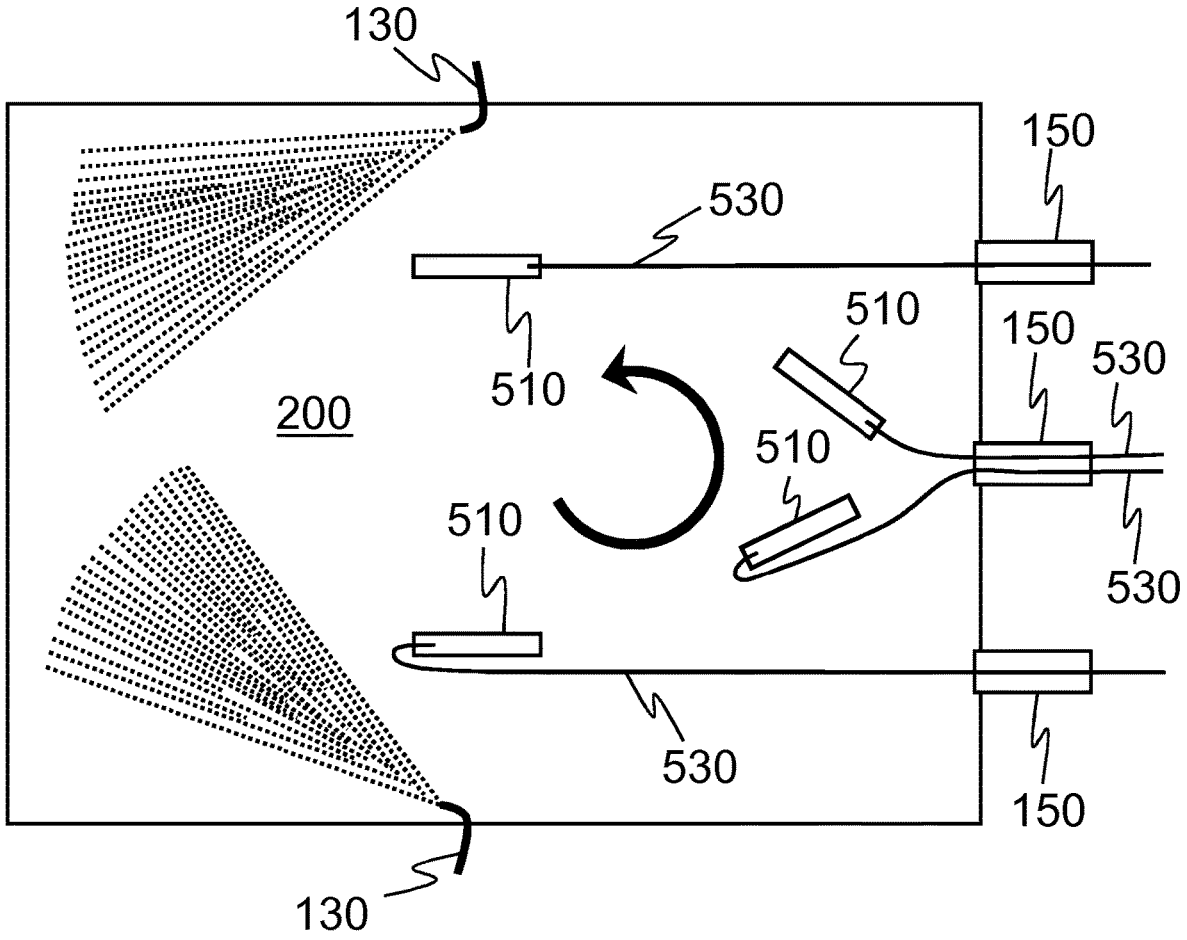
FIG. 4 shows a schematic drawing of a boiler furnace from above and installed mixing devices according to an embodiment.

FIG. 4 shows a schematic drawing from above of a boiler furnace 200 and of installed mixing devices according to an embodiment. In the embodiment of FIG. 4, the mixing devices have been installed to the furnace 200 by passing a pressure medium tube 530 of each mixing device through a smelt spout 150 (or smelt spout opening) so that a suction opening of each mixing device 510 is positioned in the furnace 200. In the embodiment of FIG. 4, two mixing devices are installed through the same smelt spout 150, while the rest of the mixing devices are installed through respective smelt spouts 150. Concurrently with the mixing of wash water in the wash water pool formed on the furnace floor by the mixing devices, in the embodiment of FIG. 4, fresh wash water is directed towards the furnace floor through liquor gun openings 130 to enhance the dissolution of the material remaining on the furnace floor. In certain embodiments, the method comprises, during washing of the boiler's upper portion, directing water through an opening in the furnace wall towards the furnace floor and concurrently mixing wash water in a wash water pool formed on the floor by mixing devices in the wash water pool. In yet certain embodiments, said mixing by mixing devices and said directing of water towards the furnace floor are performed during a washing phase in which economizers 320 of the boiler 100 are being washed.

The above described mixing may be performed during a washing phase in which superheaters 310 of the boiler 100 are being washed. In certain embodiments, said mixing by mixing devices and said directing of water towards the furnace floor are performed during a washing phase in which superheaters 310 of the boiler 100 are being washed. Washing of the superheaters 310 with sooth blowers discharges, in certain embodiments, a significant amount of wash water to the furnace floor. Therefore, in certain embodiments, the method comprises performing said mixing during a washing phase in which superheaters 310 of the boiler 100 are being washed without directing water to the furnace floor through an opening in the furnace wall.

Said mixing may be performed during a washing phase in which the underside 360 of the nose 340 is being washed. In certain embodiments, both said mixing and said washing of the underside 360 of the nose 340 are performed during a washing phase in which superheaters 310 of the boiler are being washed. Further, in certain embodiments, said mixing is performed or continued during, or as a part of, washing the furnace floor with pressure washers.

The mixing devices may be positioned in the wash water pool so that a desired movement or circulation in the wash water pool is achieved. For example, in the example shown in FIG. 4 the mixing devices are oriented so that when the pressure medium tube 530 discharges the pressure medium with a high velocity into inside of the suction pipe of the mixing devices 510 the suction pipe sucks and exits water in directions in accordance with the desired direction of circulation (which is illustrated by the arrow in FIG. 4).

The pressure washing step for washing the furnace floor from remaining solidified smelt with pressure washers comprises jetting wash water towards the furnace floor with a pressure washer. In certain embodiments, said washing of the furnace floor is performed by more than one pressure washer. In certain embodiments, the number of pressure washers is selected or determined based on the pressure washer type, or the size of the furnace, or both. Also the amount and the type of the fallen deposits and smelt remaining on the furnace floor may affect the number of pressure washers used for washing the furnace floor. The pressure washer(s) may be installed into the furnace from the outside. For example, the pressure washer(s) may be installed into the furnace through an opening or openings in the furnace wall, such as a burner opening 160 or burner openings, a secondary air port (secondary air opening) 170 or secondary air ports, and/or a liquor gun port (or liquor gun opening) 130 or liquor gun ports. In certain embodiments, the pressure washers for washing the furnace floor are installed specifically for the washing of the furnace 200 in connection with a boiler outage and the pressure washers are thus removed from the furnace 200 before start-up operations of the recovery boiler 100. In certain embodiments, the at least one pressure washer is a tank washer.

The pressure washer (or pressure washers) in certain embodiments contains a washing nozzle. In certain embodiments, a pressure washer comprises more than one washing nozzle. In certain embodiments, the washing nozzle is inserted into the furnace using a hose or a rigid piping. The pressure washer may contain a motor for actuating movement of the washing nozzle. In certain embodiments, the washing nozzle is configured to rotate or turn. In certain embodiments, the pressure washer comprises two washing nozzles each jetting a stream of water, said streams directed in opposite directions, said nozzles rotating during jetting wash water towards the floor. The washing nozzle may be actuated by the motor to move into and out from the furnace. Rotation of the washing nozzle may be actuated by the motor. The nozzle may be configured to move and turn (rotate) automatically during pressure washing. The washing nozzle may be configured to jet wash water in one direction. In certain embodiments, the washing nozzle is configured to jet wash water in two opposing directions. The size of the washing nozzle may vary between embodiments and may be selected for example based on the size of the furnace, or the number of pressure washers used in the pressure washing step, or both. The flow rate of wash water from the washing nozzle may also vary between embodiments and may be selected based on for example the size of the furnace, or the amount of solidified smelt remaining on the furnace floor, or both. In certain embodiments, the flow rate of water through the washing nozzle may be as high as several hundreds of liters per minute. The pressure of the water jet(s) from the pressure washer(s) used for recovery boiler furnace floor washing may be for example 400 bars or greater. In certain other embodiments, the pressure of the water jet(s) from the pressure washer(s) used for recovery boiler furnace floor washing is in the range from 400 to 1000 bars. The cleaning efficiency increases with pressure so that in most cases water jets exiting from nozzles with a pressure of 800-1000 bar are sufficiently efficient to clean the floor within a reasonable time. However, in few cases, for example when only relatively small amount of smelt remains on the floor and smelt is easily dissolved, cleaning can be done using water jets with considerably lower pressure. In certain other embodiments requiring increased cleaning capacity, the pressure of the water jet(s) from the pressure washer(s) used for recovery boiler furnace floor washing may be in the range from 2000 to 3000 bars.

In certain embodiments, the method comprises removing wash water from the wash water pool with at least one suction device. Preferably, in certain embodiments, the method for cleaning a black liquor recovery boiler comprises keeping, during washing the furnace floor with pressure washers, the surface of a wash water pool formed on the floor below the level of a lower edge of smelt spout openings in the furnace wall by removing wash water from the wash water pool with at least one suction device.

In certain embodiments, the wash water is removed during the washing by pressure washers from the furnace with a suction device through an opening arranged in a wall of the recovery boiler. The suction device may be installed so that a suction pipe of the suction device extends below the level of the opening into the wash water pool on the floor of the furnace. Preferably, the suction device is arranged in a smelt spout or smelt spout opening, and hence, in these embodiments, wash water is sucked from below the level of the smelt spouts (or smelt spout openings). In other words, wash water that cannot be removed through the smelt spouts by gravitation may, in certain embodiments, be removed during the washing by pressure washers with the at least one suction device so that the upper level of the wash water pool sinks below the lower edge of the smelt spout openings. In embodiments in which the smelt spout openings are arranged in the furnace wall at different heights, wash water may be removed during the pressure wash step from the wash water pool with the at least one suction device so that the upper level of the wash water pool sinks below the lower edge of the smelt spout opening(s) closest to the furnace floor. The furnace may have more than one smelt spouts and consequently more than one smelt spout opening. A suction device may be installed through one or more, even all, smelt spouts or smelt spout openings of the furnace. The number of suction devices used for removing wash water from the furnace during the washing of the furnace floor by pressure washers may be selected so that the depth of the wash water pool on the furnace floor is reduced or kept at a certain low level below the smelt spouts during pressure washing. This increases pressure washing effectiveness.

In certain embodiments, the method comprises during the washing by at least one pressure washer keeping, during washing economizers 320 and boiler bank 330, the surface of a wash water pool formed on the floor below the level of a lower edge of smelt spout openings in the furnace wall by removing wash water from the wash water pool with at least one suction device.

In certain embodiments, wash water is removed continuously during said washing by at least one pressure washer with the at least one suction device, i.e. the suction device provides a suction continuously during the washing by at least one pressure washer. In certain other embodiments, the removal of wash water during said washing by at least one pressure washer starts when a predetermined parameter is reached, for example when the wash water pool on the furnace floor reaches a predetermined size, such as a predetermined depth, or when the pressure washer(s) have jetted a predetermined volume of wash water into the furnace. The suction device may be configured to provide a suction from the furnace until said washing by at least one pressure washer is terminated, or the suction device may stop the suction from the furnace 200 when another predetermined parameter is reached, for example when the wash water pool reaches a predetermined size, such as a predetermined depth, or when a certain volume of wash water has been removed from the furnace (by the suction device). The suction device may start the suction from the furnace again when the predetermined parameter is reached, and may optionally stop the suction from the furnace again when the other predetermined parameter is reached. In certain embodiments, the suction of the at least one suction device is continued after said washing by at least one pressure washer has been terminated, or finished, to remove wash water remaining on the furnace floor after said washing. In certain embodiments, the suction device is also be used to suck sludge from the furnace floor after said washing by the at least one pressure washer has been terminated, and wash water has been removed. The wash water (and/or sludge) is, in certain embodiments, removed, directly or through a spout, from the furnace 200 into the dissolving tank 190. However, the wash water (and/or sludge) may be removed by the suction device into another suitable collection system or collection device. In the embodiment of FIG. 2, the dissolving tank 190 is positioned so that its top (roof) is approximately on the same level with the bottom of the boiler 100 and the boiler side wall of the dissolving tank 190 is approximately aligned with the rear side wall of the boiler 100. In certain embodiments, the dissolving tank may be positioned partly below the boiler.

The suction device used in certain embodiments for removing wash water from the furnace 200 during the pressure wash step may be for example an eductor, ejector or a pump or a siphon device. As to the used device it has been found that an ejector operated by pressurized air is particularly suitable for the method, but generally, any suction device suitable for sucking wash water from the furnace during said washing by at least one pressure washer may be used for removing wash water from the wash water pool during the pressure wash step in certain embodiments. In certain embodiments, a suction device for sucking molten smelt from the furnace during the step reducing the smelt bed size is used for sucking wash water from the furnace during said washing by at least one pressure washer. In certain embodiments, the same suction device(s) are used in removing molten smelt from the furnace and in removing wash water from the furnace. In certain other embodiments, different suction device(s) are used in removing molten smelt from the furnace and in removing wash water from the furnace. The conditions during wash water removal are less demanding than during removal of molten smelt, which may reflect on the selected suction device(s). In certain embodiments, a suction pipe of a suction device for smelt removal is 3-5 m long. In certain embodiments, a suction pipe of a suction device for wash water removal is 1-2 m long. In certain embodiments, the number of suction devices is the same when reducing the size of the smelt bed and when removing wash water from the wash water pool on the furnace floor.

Figure 5:
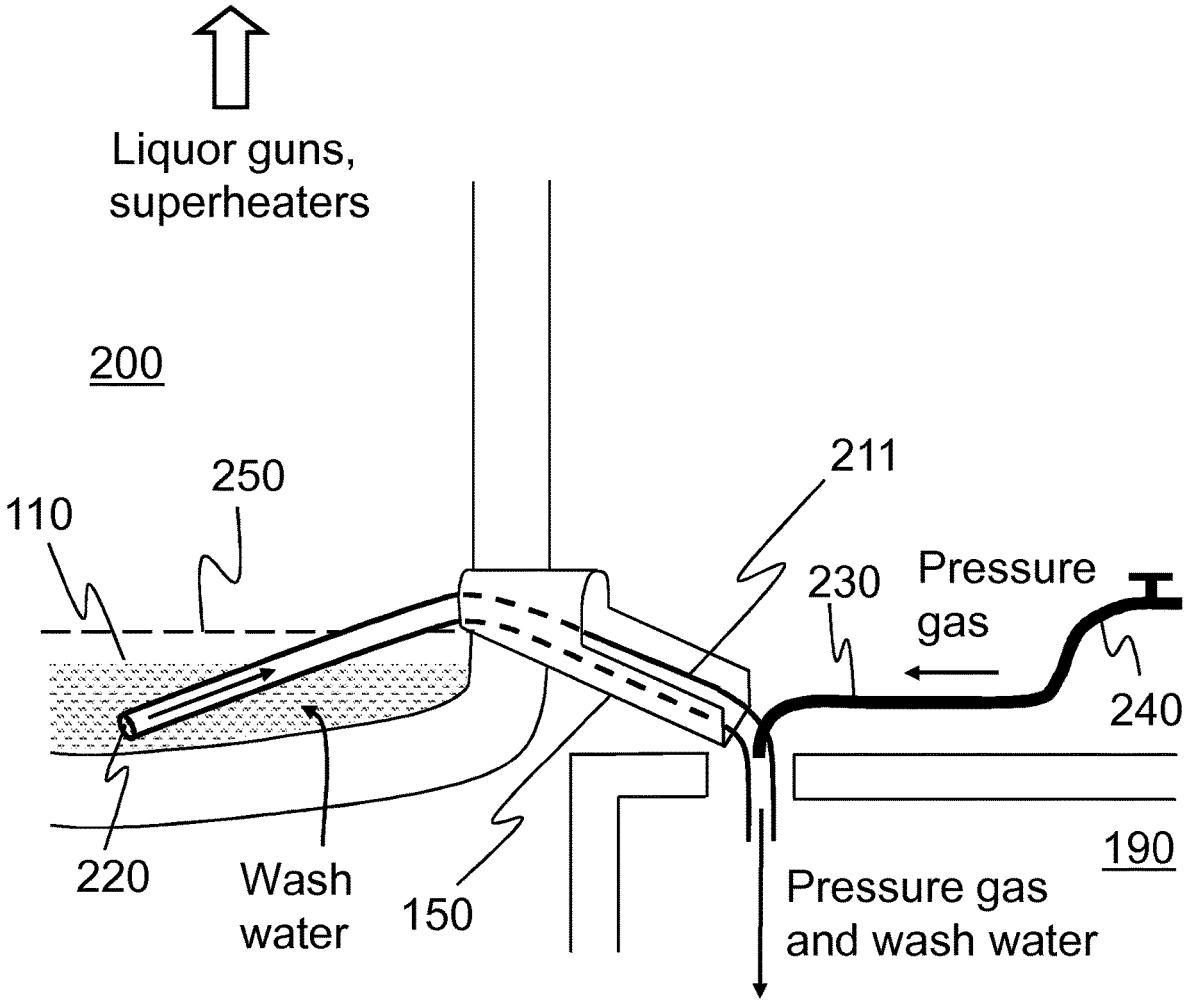
FIG. 5 shows a schematic drawing of an ejector installed in place for removing wash water from the furnace according to an embodiment.

FIG. 5 shows a schematic drawing of an ejector (or eductor) installed in place for removing wash water from the furnace 200 according to an embodiment. The dashed horizontal line 250 denotes in the embodiment of FIG. 5 the level below which the surface of the wash water pool is kept during washing with at least one pressure washer. In the embodiment of FIG. 5, the suction pipe 211 of the ejector is installed in the smelt spout 150, whereby the suction end of the ejector is pushed via the smelt spout opening into the wash water pool 110 on the furnace 200 floor, below the surface of the pool 110 and close to the floor. In the embodiment of FIG. 5, a pressurized gas conduit 230 in fluid connection with a pressurized gas line 240 is inserted into the ejector to provide a pressurized gas flow creating a suction in the ejector from the mouth 220 of the suction end towards the dissolving tank 190. In certain embodiments, the suction device is an ejector/eductor based on negative pressure suction. In certain embodiments, the at least one suction device is removed from the furnace 200 through the opening in the furnace wall through which it was installed after having removed wash water from the wash water pool by said at least one suction device.

The water jet(s) from the pressure washer(s) removes solidified smelt mainly mechanically, for example by breaking the surface of the solidified smelt into small pieces or flakes. Therefore, pressure washers are more effective in removing the remaining solidified smelt from the furnace floor when the solidified smelt to be removed is above water surface, i.e. when at least a portion of the smelt to be removed forms a high pile, or when the wash water pool on the furnace floor is shallow. If the material to be removed from the furnace floor is mainly or fully below the surface of the wash water pool, the effectiveness and the efficiency of the pressure washer(s) decreases. A water jet from the pressure washer attenuates quickly when it travels through a layer of water. Therefore, a water jet having travelled through a layer of water before meeting solid smelt has a reduced force. The higher the layer of wash water above the solid smelt to be removed, the more pronounced is the decrease in efficiency of the water jet from the pressure washer. By removing water from the furnace with at least one suction device during said washing by at least one pressure washer, the wash water pool formed on the furnace floor may be decreased in size, i.e. the layer of water above a layer or pile of solid smelt is decreased or removed, thus rendering the washing step performed by pressure washers more effective and efficient. When water is not removed from the furnace floor by a suction device (i.e. only gravitational removal of water through openings in the furnace wall occurs), the loss in effectiveness may be compensated by extending the duration of the pressure wash step and/or by increasing the number of washing nozzles (or pressure washers). Thus, removing wash water from the furnace with at least one suction device is not necessarily required when washing the furnace floor.

The number of washing nozzles (and/or pressure washers) used and their locations in the furnace 200 may be decided on the basis of the time allocated (desired duration) for the pressure wash step and the amount of material to be removed from the furnace floor, and whether or not the size of the wash water pool is to be decreased during the pressure wash step. In certain embodiments, one or two washing nozzles are used during said washing by at least one pressure washer. The pressure washing may comprise changing the location(s) of the washing nozzle(s) or pressure washers so that the furnace floor is thoroughly washed by the jet(s) of water from the washing nozzle(s). In certain embodiments, two washing nozzles are used simultaneously.

In certain embodiments, the method comprises: performing washing of the rear wall side of the furnace floor by at least one pressure washer installed below the nose 340 during a washing phase in which the superheaters of the recovery boiler are being washed. Since solid deposit(s) from the superheaters mainly falls to the front wall side, washing with a pressure washer installed, from the outside of the furnace, into the rear wall side of the furnace may be carried out safely while deposit blocks may still fall down from the superheaters. In certain embodiments, performing washing by at least one pressure washer installed below the nose is performed after washing the underside 360 of the nose 340.

Figure 6:
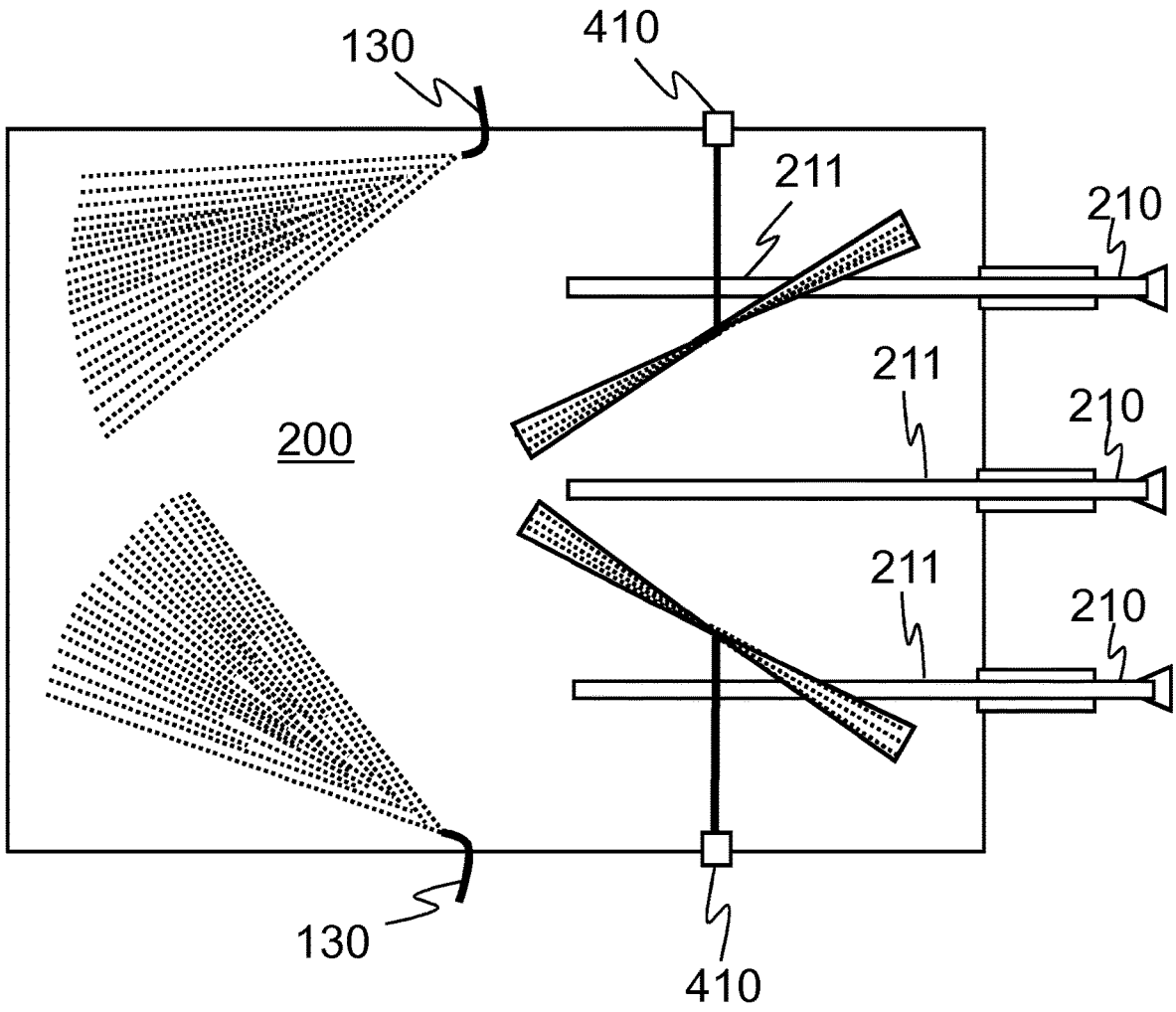
FIG. 6 shows a schematic drawing of a boiler furnace from above and installed pressure washers and suction devices according to an embodiment.

FIG. 6 shows a schematic drawing from above of a boiler furnace 200 and of installed pressure washers according to an embodiment. In the embodiment of FIG. 6, pressure washers 410 are installed into the furnace from the outside through openings in the furnace wall to the rear wall side of the furnace 200, and ejectors 210 for removing wash water from the furnace 200 during washing by at least one pressure washer are installed through the smelt spouts openings. In the embodiment of FIG. 6, the ejectors 210 comprise suction pipes 211 extending to the deepest spot of the wash water pool. In certain embodiments, the at least one pressure washer is installed to the rear wall side of the furnace 200 through an opening in the rear wall of the furnace 200.

Further, in the embodiment of FIG. 6, liquor guns 130 conduct (or spray) water on solid deposits that has been released from the superheaters when washing with soot blowers and fallen to the furnace floor. In certain other embodiments, wash water is directed (or conducted) during said washing by at least one pressure washer to the front wall side using water guns or hoses or nozzles installed into or through burner openings or liquor ports or primary air ports (air openings). In certain embodiments, fresh water is directed (or sprayed) into the furnace through an opening in the front wall while performing washing by at least one pressure washer installed below the nose 340.

In certain embodiments, the method comprises: performing washing of the rear wall side of the furnace floor by at least one pressure washer installed below the nose 340 during a washing phase in which the economizers (or boiler bank) of the recovery boiler are being washed. In certain embodiments, the method comprises: during a washing phase in which the economizers (or boiler bank) of the recovery boiler are being washed, directing fresh wash water into the furnace through an opening in the furnace wall.

Figure 7:
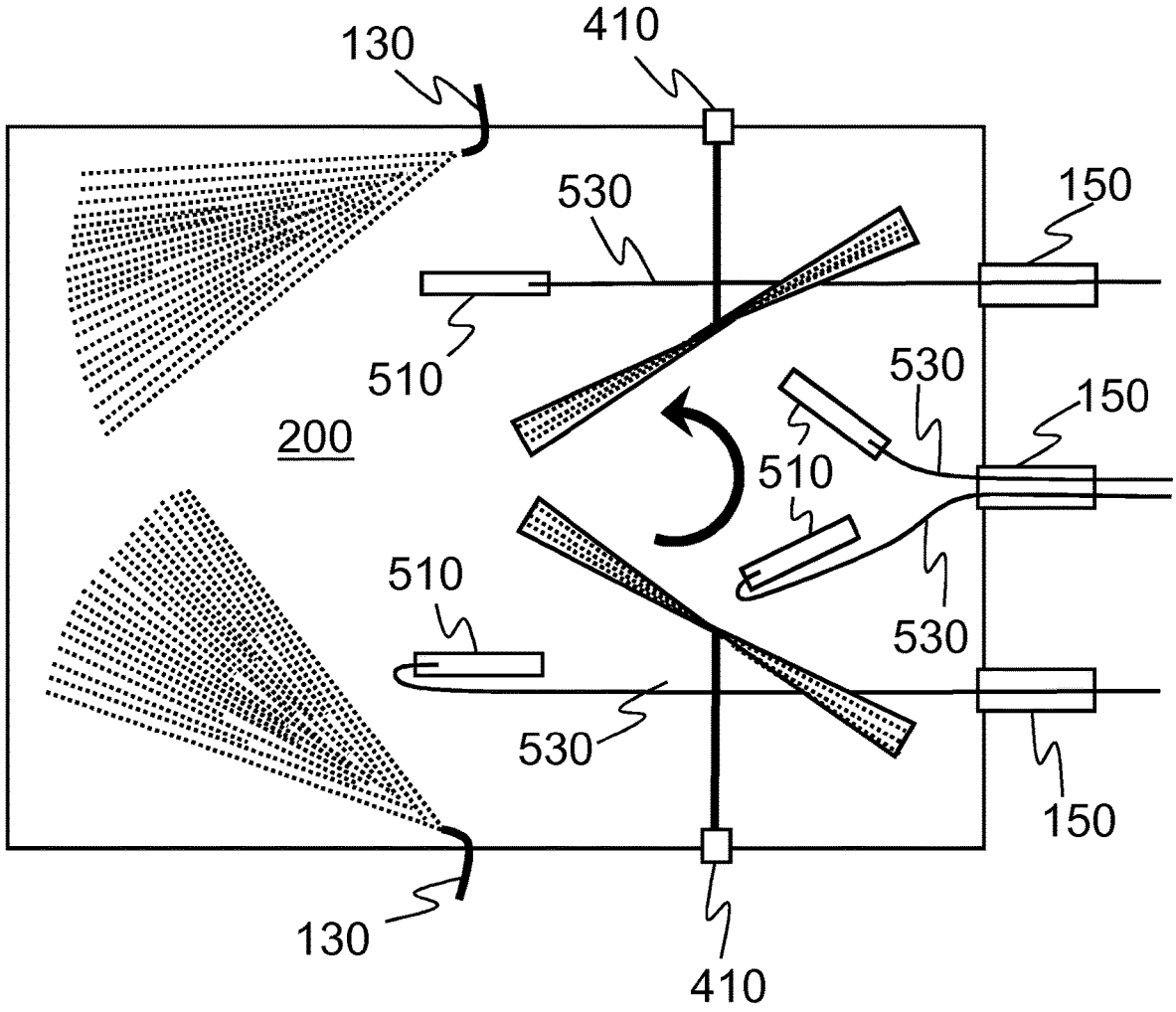
FIG. 7 shows a schematic drawing of a boiler furnace from above and installed mixing devices and pressure washers according to an embodiment.

FIG. 7 shows a schematic drawing from above of a boiler furnace 200 and of installed mixing devices and pressure washers according to an embodiment. In the embodiment of FIG. 7, pressure washers 410 installed below the nose 340 (i.e. in the rear wall side of the furnace 200) jets wash water towards the furnace floor while mixing devices 510 installed through smelt spouts 150 into the wash water pool on the furnace floor mix wash water in said wash water pool. The mixing devices 510 may be positioned in the wash water pool so that a desired movement or circulation in the wash water pool is achieved similarly as described in connection with FIG. 4. Further, fresh wash water is directed towards the furnace floor through liquor gun openings 130 to enhance the dissolution of solid deposits and/or solid smelt remaining on the furnace floor.

In certain embodiments, washing of the furnace floor comprises, during a washing phase in which the superheaters 310 of boiler 100 are being washed, concurrently mixing wash water in the wash water pool by mixing devices in the wash water pool, and jetting wash water towards the floor by at least one pressure washer installed into the furnace through an opening in the furnace wall, and directing fresh wash water through an opening in the furnace wall towards the furnace floor. In yet certain embodiments, washing of the furnace floor comprises, during a washing phase in which the economizers 320 (or boiler bank 330) of the boiler 100 are being washed, concurrently mixing wash water in the wash water pool by mixing devices in the wash water pool, and jetting wash water towards the floor by at least one pressure washer 410 installed into the furnace through an opening in the furnace wall, and directing fresh wash water through an opening in the furnace wall towards the furnace floor.

Figure 8:
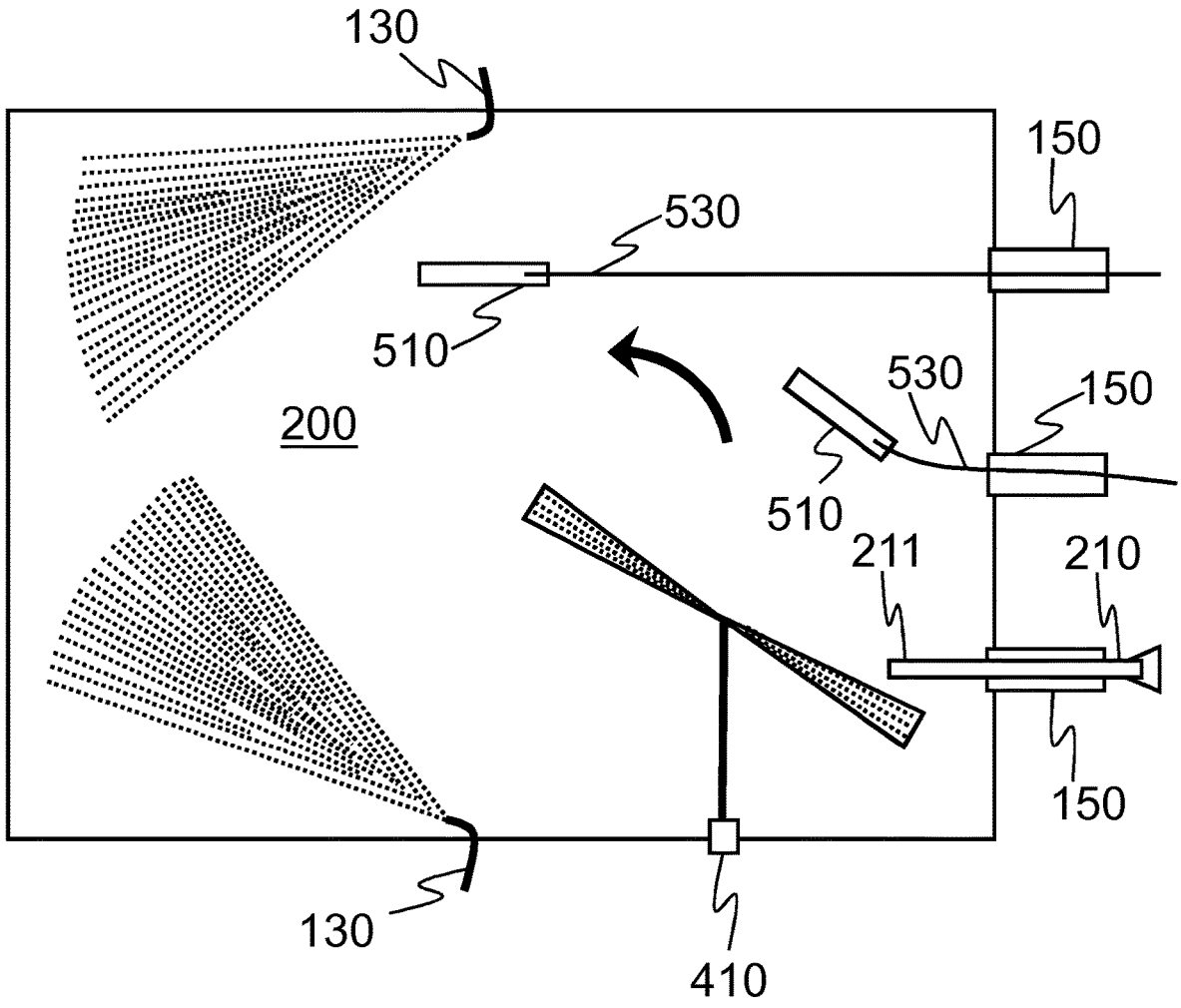
FIG. 8 shows a schematic drawing of a boiler furnace from above and installed mixing devices, pressure washer and suction device according to an embodiment.

FIG. 8 shows a schematic drawing from above of a boiler furnace 200 and of installed mixing devices, pressure washer and suction device according to an embodiment. In the embodiment of FIG. 8, the suction ends of mixing devices 510 have been installed into the furnace 200 by passing pressure medium tubes 530 of said mixing devices through smelt spouts 150. Further, a suction device 210 for removing wash water from the wash water pool formed on the furnace floor has been installed through a smelt spout 150 so that the suction pipe 211 of the suction device 210 extends into the wash water pool. Further, a pressure washer 410, installed into the rear wall side of the furnace through an opening in the furnace wall, jets wash water towards the furnace floor. In the embodiment of FIG. 8, the dissolution of material (solid smelt and fallen deposits) remaining on the furnace floor is further enhanced by conducting fresh wash water towards the furnace floor through liquor gun openings 130 concurrently with said mixing step, pressure wash step, and removal of wash water with the suction device 210. Removing wash water from the wash water pool with a suction device also removes smelt and deposits dissolved into said wash water pool thus preventing saturation of the water in the wash water pool. In the embodiments of FIG. 8, the wash water flow direction during mixing is in counter clockwise direction (as seen from above). By placing the suction device 210, as in the embodiment of FIG. 8, so that it sucks water from the wash water pool in the wash water flow direction generated by said mixing by mixing devices, the movement of water in the wash water pool may be enhanced (thus enhancing the mixing of the water in the wash water pool which in turn expedites dissolution of smelt and deposits into the wash water pool).

In certain embodiments, the method comprises, during a washing phase in which the superheaters 310 of the boiler 100 are being washed, concurrently performing mixing of wash water in the wash water pool by the mixing devices, jetting of wash water by at least one pressure washer 410, removing wash water from the wash water pool with at least one suction device 210, and directing fresh wash water towards the furnace floor through an opening in the furnace wall. In yet certain embodiments, the method comprises, during a washing phase in which the economizers 320 (or boiler bank 330) of the boiler 100 are being washed, concurrently performing mixing of wash water in the wash water pool by the mixing devices, jetting of wash water by at least one pressure washer 410, removing wash water from the wash water pool with at least one suction device 210, and directing fresh wash water towards the furnace floor through an opening in the furnace wall.

In certain embodiments, the volume per time unit (for example $m^3/h$) of wash water jetted by one pressure washer into the furnace substantially equals the volume per time unit of wash water removed by one suction device from the furnace.

In certain embodiments, pressure washers are installed into the front wall side of the furnace after (large) deposit blocks have been washed from the superheaters, i.e. when large deposit blocks are no longer falling from the superheaters risking to damage washing equipment installed in the front wall side. In certain embodiments, particularly, if solid deposit originating from the superheaters remains on the furnace floor on the front wall side of the furnace when starting the washing by at least one pressure washer at the front wall side, wash water is directed by water guns or hoses into the front wall side of the furnace.

In certain embodiments, the remaining parts of the boiler's upper portion after superheaters of the boiler have been washed are washed during washing by at least one pressure washer the front wall side of the furnace floor. In certain embodiments, the front wall side of the furnace floor is the portion of the furnace floor that is not below the nose 340. In certain embodiments, washing the front wall side of the furnace floor by at least one pressure washer is performed after superheaters of the boiler have been washed.

In certain embodiments, washing of the front wall side with at least one pressure washer begins while washing of superheaters with soot blowers is still on-going. If the superheaters are so clean that there is no risk that a large smelt block could fall and hit a pressure washer installed in the front wall side, pressure washers may be installed in the front wall side of the furnace and pressure washing of the front wall side of the furnace floor may begin even if the washing of superheaters is still ongoing. Initially, washing of the superheaters releases (large) blocks of solid deposit, but as the washing of superheaters goes on, significant pieces of solid deposit will no longer be released and washing equipment may safely be installed in the front wall side of the furnace. In certain embodiments, it is possible to start washing the furnace floor on the front wall side with pressure washers relatively early, for example when only one third of the time reserved for superheater washing has been consumed.

The boiler's upper portion may be inspected through a man door or an inspection hatch (or inspection hatches) to determine whether the washing of the boiler's upper portion has been completed. In other words, the boiler's upper portion may be inspected to determine whether said upper portion is clean enough. In certain embodiments, the method comprises: inspecting through a man door or one or more inspection hatches in the boiler's upper portion the superheaters, particularly to determine whether the at least one pressure washer can be safely installed in the front wall side of the furnace (i.e. no blocks of sold deposit having a significant size remain on the superheaters).

Figure 9:
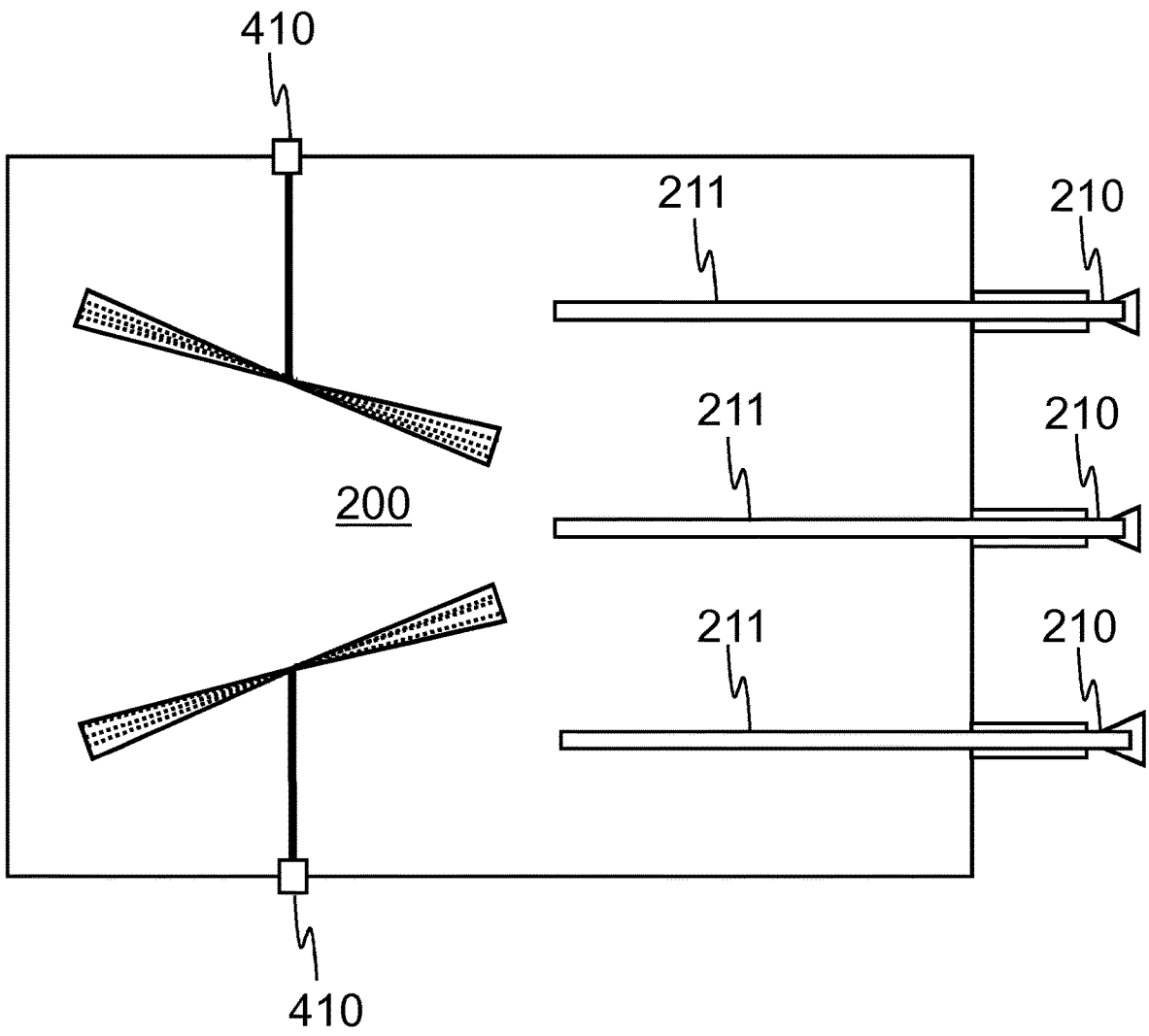
FIG. 9 shows a schematic drawing of a boiler furnace from above and installed pressure washers and suction devices according to an embodiment.

FIG. 9 shows a schematic drawing from above of a boiler furnace 200 and of installed washing equipment according to an embodiment. In the embodiment of FIG. 9, pressure washers 410 are installed into the furnace from the outside through openings in the furnace wall to the front wall side of the furnace 200. In certain embodiments, the at least one pressure washer is installed to the front wall side of the furnace 200 through an opening in the front wall of the furnace 200. FIG. 9 further shows ejectors 210 for removing wash water from the furnace 200 during washing by at least one pressure washer installed through the smelt spouts. In the embodiment of FIG. 9, the ejectors 210 comprise suction pipes 211 extending to the deepest spot of the wash water pool.

In certain embodiments, wash water is directed to the rear wall side by (liquor or water) guns or hoses installed into burner openings or liquor ports or primary air ports (air openings) during said washing by at least one pressure washer. In certain embodiments, fresh wash water is conducted (or sprayed) into the furnace through an opening in the rear wall while performing washing by at least one pressure washer installed in the front wall side. In certain embodiments, the underside 360 of the nose 340 is washed during washing by at least one pressure washer the front wall side of the furnace floor.

In certain embodiments, the method comprises starting said washing by at least one pressure washer by performing washing of the rear wall side of the furnace floor by at least one pressure washer installed below the nose 340. In other words, in certain embodiments, performing washing of the rear wall side of the furnace floor by at least one pressure washer is started before starting washing by at least one pressure washer the front wall side of the furnace floor. In certain embodiments, the washing of the furnace floor by at least one pressure washer is performed concurrently at the rear wall side and at the front wall side of the furnace. In certain embodiments, washing of the furnace floor with pressure washers at the rear wall side and at the front wall side is started at different times, but a portion of the washing with pressure washers is performed simultaneously.

Once the washing steps comprising washing by mixing wash water in the wash water pool by mixing device(s), jetting wash water towards the furnace floor with a pressure washer and the washing steps comprising washing by one or more soot blowers have been completed, a scaffolding for entering the furnace may be installed. The cleaning of the recovery boiler may then comprise manually performed cleaning steps using hand held tools if necessary. Such steps are for example hydroblasting, chiseling or jackhammering. A safety roof protecting from falling pieces or blocks of solid deposits (if any) may be installed before allowing persons to enter the furnace 200.

Figure 10:
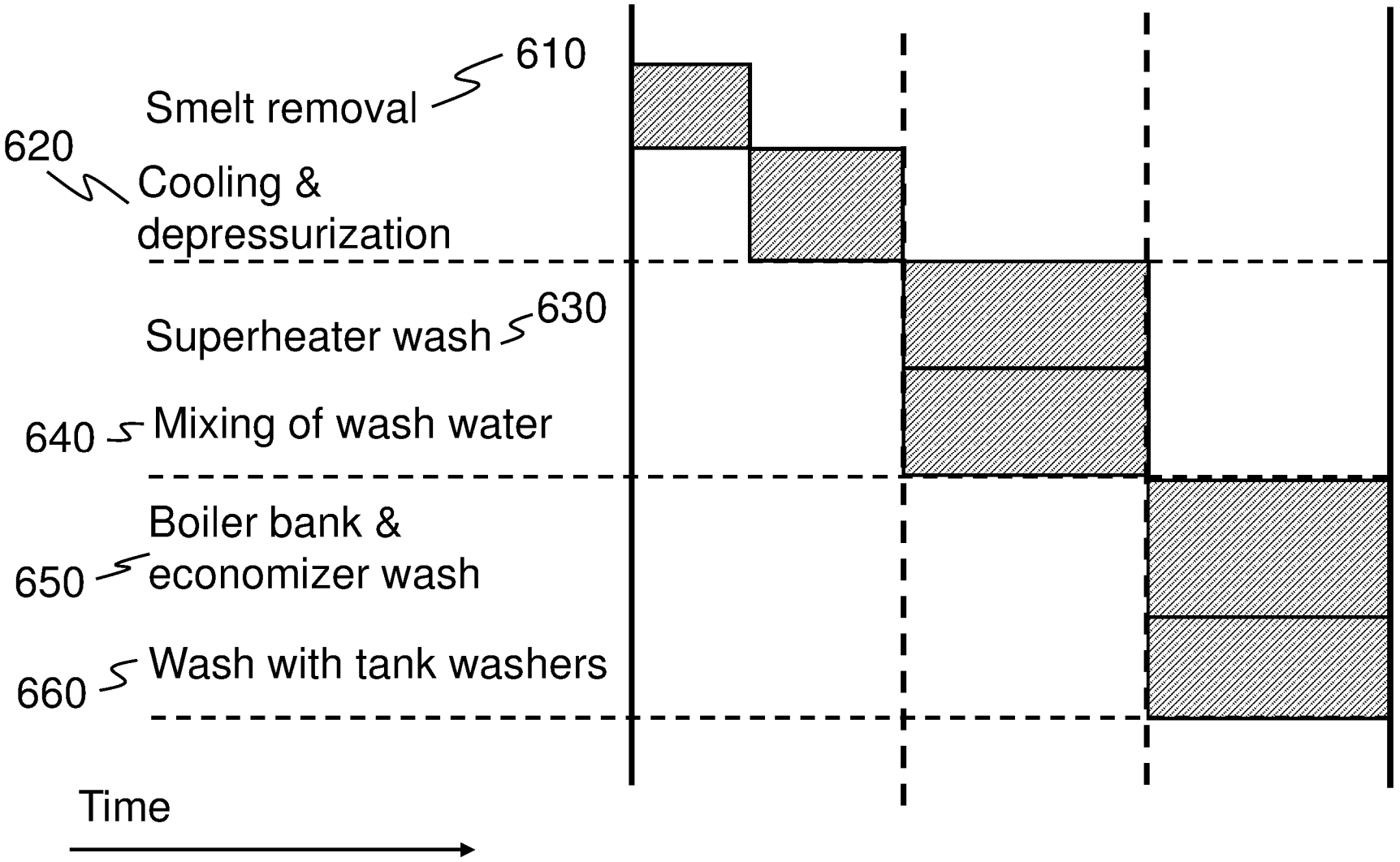
FIG. 10 shows a timing diagram illustrating timing of method steps according to an embodiment.

FIG. 10 shows according to an embodiment a timing diagram illustrating timing of steps comprised in the method for cleaning a black liquor recovery boiler. In the embodiment of FIG. 10, cleaning of the recovery boiler 100 is started by smelt removal 610 from the furnace 200 by at least one suction device. After the smelt removal 610, cooling and depressurization 620 of the boiler 100 is performed. After said cooling and depressurization 620, superheater wash 630 with at least one soot blower is performed concurrently with mixing of wash water 640 in the wash water pool formed on the furnace floor to dissolve smelt on the furnace floor. After the superheater wash 630 and mixing of wash water 640 have been performed, a boiler bank and economizer wash 650 with a soot blower is performed while concurrently washing with tank washers 660 the furnace floor keeping the surface of the wash water pool below the level of a lower edge of smelt spout openings in the furnace wall by removing wash water from the wash water pool with at least one suction device. Optionally, the underside 360 of the nose 340 protruding from the rear wall of the furnace 200 may be washed during the superheater wash 630 and the mixing of wash water in the wash water pool 640. Then, any remaining wash water may be removed from the furnace 200 and optional manual cleaning steps may be performed to complete the cleaning of the recovery boiler 100. In certain embodiments, in which more than one, for example two or three, soot blowers or pairs of soot blowers are used simultaneously in different sections of the boiler, the washing of the furnace floor with tank washers 660 and the boiler bank and economizer wash 650 can be started at the same time as the superheater wash 630 and the mixing of wash water 640 in the wash water pool on the furnace floor. Performing these steps 630, 640, 650, 660 simultaneously further shortens the time required to complete the cleaning of the recovery boiler. In certain embodiments, washing of the boiler's upper portion is started by the economizers and boiler bank wash 650 while performing wash with tank washers 660, i.e. step 650 and at least a part of step 660 takes place prior to the superheater wash 630 and the mixing of wash water 640, i.e. prior to steps 630 and 640.

Figure 11:
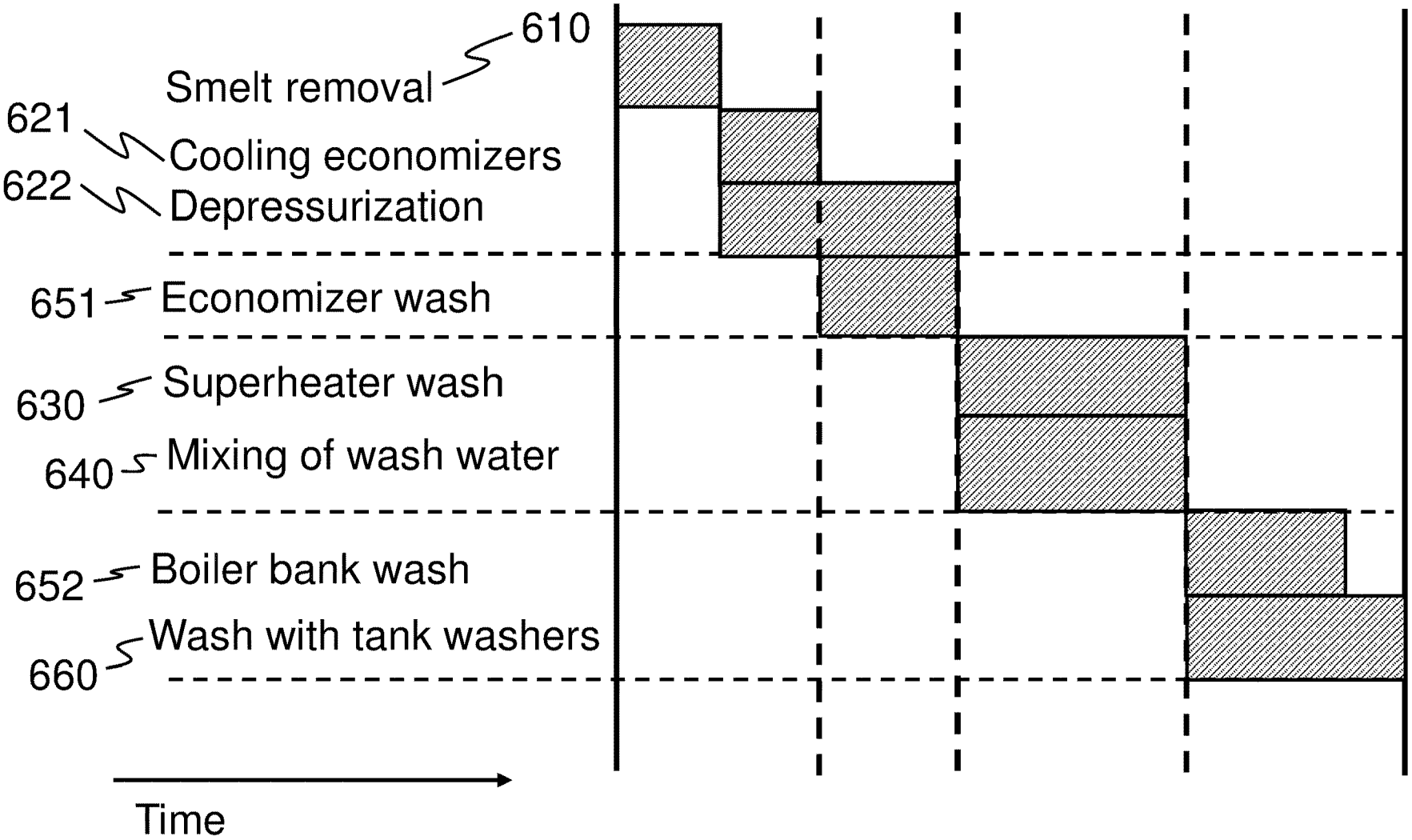
FIG. 11 shows a timing diagram illustrating timing of method steps according to another embodiment.

FIG. 11 shows according to another embodiment a timing diagram illustrating timing of steps comprised in the method for cleaning a black liquor recovery boiler. In the embodiment of FIG. 11, cleaning of the recovery boiler 100 is started by smelt removal 610 from the furnace 200 by at least one suction device 210. After the smelt removal 610, in the embodiment of FIG. 11, cooling economizers 621 by circulating feedwater through the economisers is started together with the depressurization 622 of the boiler 100 (and with the depressurization 622, cooling of the remaining parts of the boiler starts as well). The economizer wash 651 may start as soon as the economizers are cool enough, for example when the economizer material temperatures are 150° C. or less. Since cooling economizer 621 by circulating feedwater through the economisers is faster than the depressurization 622 of the boiler, the economizer wash 651 is performed, in the embodiment of FIG. 11, during the time remaining for depressurization (and cooling of the remaining parts of the boiler). In the embodiment of FIG. 11, after steps 621, 622, and 651, the superheater wash 630 is performed simultaneously with mixing of wash water 640. Once the superheater wash 630 and the mixing of wash water 640 have been performed, the boiler bank wash 652 is started substantially simultaneously as the wash with tank washers 660 is started. In the embodiment of FIG. 11, the boiler bank wash 652 is performed faster than the wash with tank washers 660, i.e. step 652 is terminated before step 660. Then, any remaining wash water may be removed from the furnace 200 and optional manual cleaning steps may be performed to complete the cleaning of the recovery boiler 100. In certain embodiments, in which cooling economizers 621 is completed before depressurization 622 of the boiler 100, wash with tank washers 660 is started after depressurization 622 and substantially simultaneously with the superheater wash 630 and mixing of wash water 640. In such embodiments, the wash with tank washers 660 is preferably performed so that the at least one tank washer is first installed under the nose 340 in the rear wall side of the furnace 200 and then, as the superheater wash 630 proceeds, at least one tank washer is installed or moved to the front wall side of the furnace 200. In such embodiments, the boiler bank wash may be completed simultaneously with (or at least not before) completing wash with thank washers 660. In certain embodiments, in which cooling economizers 621 is completed before depressurization 622, and wash with tank washers 660 is started after depressurization and substantially simultaneously with the superheater wash 630 and mixing of wash water 640, mixing of wash water 640 is continued when performing the boiler bank wash 652 performed after the superheater wash 630. In certain embodiments, the mixing of wash water 640 may be continued after the superheater wash 630 has been performed (said mixing step 640 ending at the latest once the boiler bank wash 652 and wash with tank washers 660 have been completed).

Without limiting the scope and interpretation of the patent claims, certain technical effects of one or more of the example embodiments of this disclosure are listed in the following. A technical effect is an improved washing efficiency so that the floor may be washed relatively clean while the boiler's upper portion (i.e. the super heaters, boiler banks and economizers) is being washed with soot blowers. Therefore, the washing of the boiler may be completed once the washing by soot blowers (the washing of the boiler's upper portion) is completed. Consequently, the time reserved for boiler cleaning may be reduced significantly, for example by 12-24 hours. Further, the pressure washing may be performed with a reduced number of pressure washers compared to conventional methods. Yet further, the cleaning result is improved compared to conventional methods.

Various embodiments have been presented. It should be appreciated that in this document, words comprise, include and contain are each used as open-ended expressions with no intended exclusivity.

The foregoing description has provided by way of non-limiting examples of particular implementations and embodiments of the present disclosure a full and informative description of the best mode presently contemplated by the inventors for carrying out the disclosed embodiments. It is however clear to a person skilled in the art that the present disclosure is not restricted to details of the embodiments presented in the foregoing, but that it can be implemented in other embodiments using equivalent means or in different combinations of embodiments without deviating from the characteristics of the disclosed embodiments.

Furthermore, some of the features of the afore-disclosed embodiments of this present disclosure may be used to advantage without the corresponding use of other features. As such, the foregoing description shall be considered as merely illustrative of the principles of the present disclosure, and not in limitation thereof. Hence, the scope of the disclosed embodiments is only restricted by the appended patent claims.

The invention claimed is:

1. A method for cleaning a black liquor recovery boiler, comprising washing a floor of a furnace of the boiler, said washing comprising:

mixing wash water in a wash water pool formed on the floor by at least one mixing device in the wash water pool;

mechanically removing solidified smelt on the floor by jetting wash water towards the floor by at least one pressure washer installed into the furnace through an opening in a wall of the furnace, and starting said mixing the wash water in the wash water pool prior to starting said jetting of wash water by the at least one pressure washer, wherein the water pressure used in the at least one pressure washer is 40 MPa or greater.

2. The method of claim 1, comprising:

removing wash water from the wash water pool with at least one first suction device during said jetting of wash water by at least one pressure washer.

3. The method of claim 1, comprising:

keeping, during said jetting of wash water by at least one pressure washer, the surface of the wash water pool formed on the floor below the level of a lower edge of smelt spout openings in the furnace wall by removing wash water from the wash water pool with at least one first suction device.

4. The method of claim 1, comprising:

removing smelt in a molten state from the furnace floor by at least one second suction device prior to said washing.

5. The method of claim 1, wherein the mixing is performed by sucking wash water in the wash water pool into suction opening(s) of the at least one mixing device and discharging the sucked wash water back through discharge opening(s) of the at least one mixing device.

6. The method of claim 1, comprising:

performing said mixing during a washing phase in which superheaters of the boiler are being washed.

7. The method of claim 1, comprising:

washing an underside of a nose protruding from a wall of the furnace by directing fresh wash water to said underside during a washing phase in which superheaters of the boiler are being washed.

8. The method of claim 1, comprising: washing an underside of a nose protruding from a wall of the furnace by directing fresh wash water to said underside during said mixing of wash water in the wash water pool.

9. The method of claim 1, comprising:

performing said jetting of wash water by at least one pressure washer during washing remaining parts of the boiler's upper portion, said remaining parts comprising economizers and a boiler bank, after superheaters of the boiler have been washed.

10. The method of claim 1, comprising:

performing at least part of said jetting of wash water by the at least one pressure washer during a washing phase in which superheaters of the boiler are being washed.

11. The method of claim 1, comprising:

starting the washing of boiler's upper portion from superheaters.

12. The method of claim 1, comprising:

performing said washing a furnace floor of the boiler during washing phases in which superheaters, economizers, and a boiler bank of the boiler are being washed.

13. The method of claim 1, comprising:

removing the wash water by an ejector or an eductor or a siphon device during the washing of the furnace floor.

14. The method of claim 13, wherein said ejector or eductor is operated by pressurized air.

15. The method of claim 1, wherein the opening in the wall of the furnace through which said at least one pressure washer is installed into the furnace is an opening other than a smelt spout opening.

16. The method of claim 1, wherein the water pressure for the at least one pressure washer is raised by a pressure-boosting pump.

17. An apparatus for cleaning a black liquor recovery boiler, comprising means for performing the method of claim 1.

* * * * *